US007258562B2

(12) United States Patent
Daily et al.

(10) Patent No.: US 7,258,562 B2
(45) Date of Patent: Aug. 21, 2007

(54) ELECTRICAL POWER CONTACTS AND CONNECTORS COMPRISING SAME

(75) Inventors: Christopher G. Daily, Harrisburg, PA (US); Wilfred J. Swain, Mechanicsburg, PA (US); Stuart C. Stoner, Lewisberry, PA (US); Christopher J. Kolivoski, York, PA (US); Douglas M. Johnescu, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 189 days.

(21) Appl. No.: 11/019,777

(22) Filed: Dec. 21, 2004

(65) Prior Publication Data

US 2006/0003620 A1 Jan. 5, 2006

Related U.S. Application Data

(60) Provisional application No. 60/533,822, filed on Dec. 31, 2003, provisional application No. 60/533,749, filed on Dec. 31, 2003, provisional application No. 60/533,750, filed on Dec. 31, 2003, provisional application No. 60/534,809, filed on Jan. 7, 2004, provisional application No. 60/545,065, filed on Feb. 17, 2004.

(51) Int. Cl.
*H01R 13/28* (2006.01)

(52) U.S. Cl. ..... 439/290

(58) Field of Classification Search ..... 439/290, 439/291, 284, 287, 295
See application file for complete search history.

(56) References Cited

U.S. PATENT DOCUMENTS

| | | | | |
|---|---|---|---|---|
| 318,186 | A | 5/1885 | Hertzog | |
| 741,052 | A | 10/1903 | Mahon | |
| 3,011,143 | A | 11/1961 | Dean | |
| 3,178,669 | A | 4/1965 | Roberts | |
| 3,411,127 | A | 11/1968 | Adams | |
| 3,514,740 | A * | 5/1970 | Filson | 439/290 |
| 3,634,811 | A * | 1/1972 | Teagno et al. | 439/290 |
| 3,845,451 | A | 10/1974 | Neidecker | |
| 3,972,580 | A * | 8/1976 | Pemberton et al. | 439/290 |
| 4,403,821 | A * | 9/1983 | Zimmerman et al. | 439/408 |
| 4,552,425 | A * | 11/1985 | Billman | 439/295 |
| 4,564,259 | A * | 1/1986 | Vandame | 439/852 |
| 4,820,182 | A | 4/1989 | Harwath et al. | |
| 5,035,639 | A * | 7/1991 | Kilpatrick et al. | 439/290 |
| 5,104,332 | A * | 4/1992 | McCoy | 439/290 |
| 5,577,928 | A * | 11/1996 | Duclos | 439/290 |
| 5,588,859 | A * | 12/1996 | Maurice | 439/290 |
| 6,193,537 | B1 * | 2/2001 | Harper et al. | 439/291 |

* cited by examiner

*Primary Examiner*—Gary F. Paumen
(74) *Attorney, Agent, or Firm*—Woodcock Washburn LLP

(57) ABSTRACT

Electrical connectors and contacts for transmitting power are provided. One power contact embodiment includes a first plate that defines a first non-deflecting beam and a first deflectable beam, and a second plate that defines a second non-deflecting beam and a second deflectable beam. The first and second plates are positioned beside one another to form the power contact.

25 Claims, 19 Drawing Sheets

FIG. 34
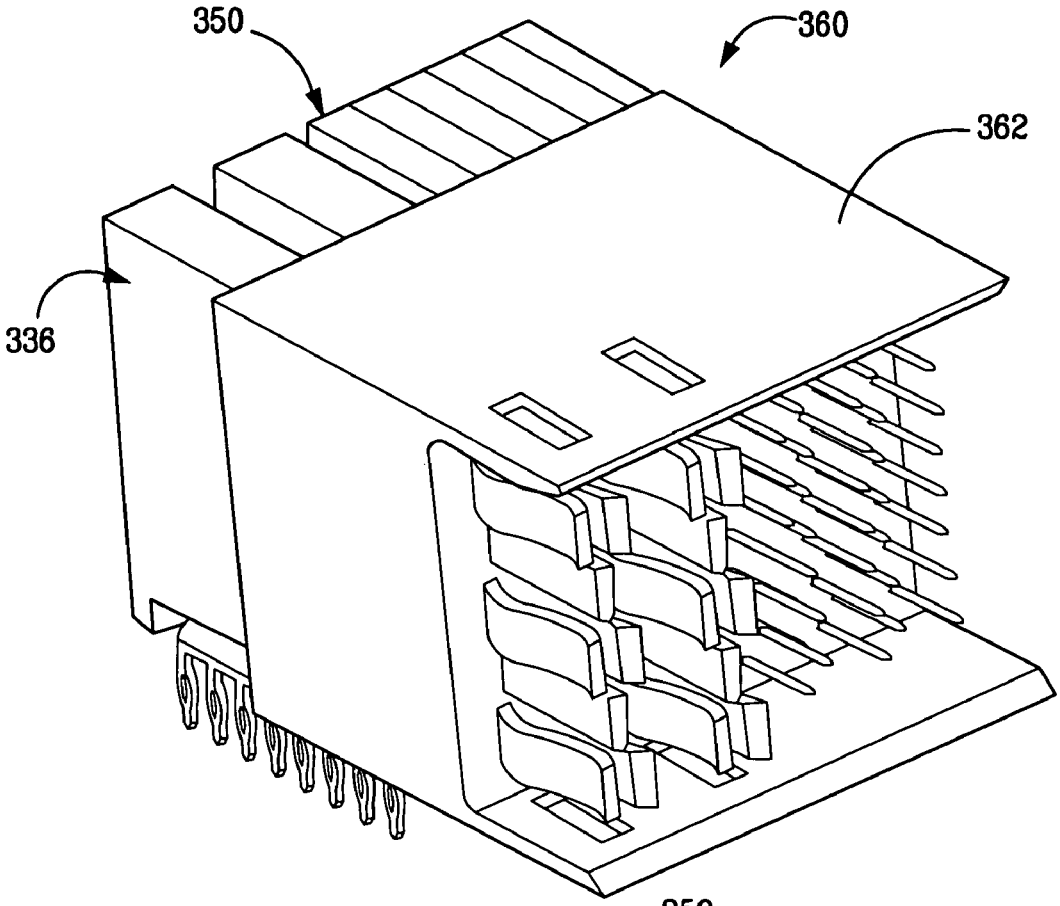
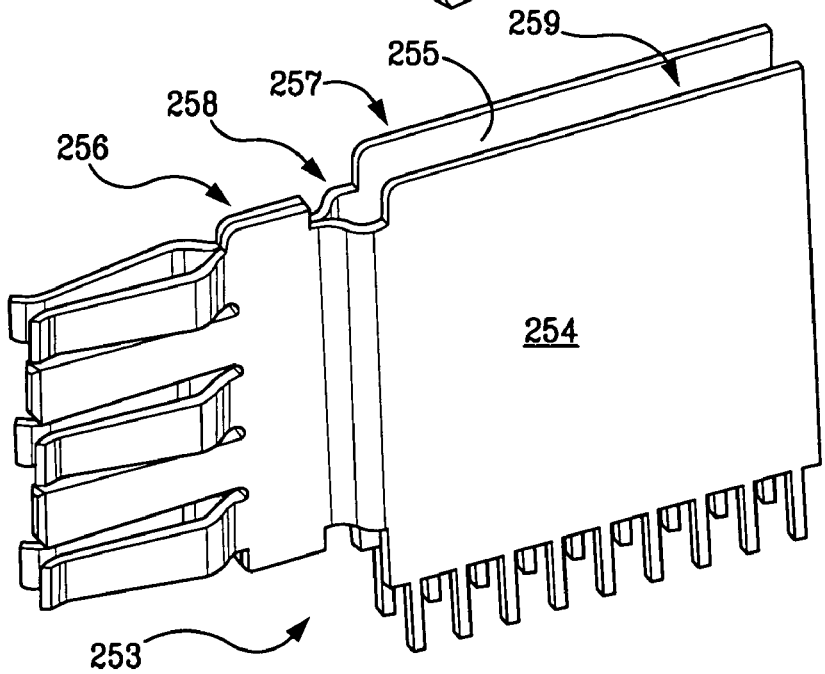
FIG. 35

ELECTRICAL POWER CONTACTS AND CONNECTORS COMPRISING SAME

CROSS REFERENCE TO RELATED APPLICATIONS

This application claims the benefit of U.S. Provisional Application Nos. 60/533,822, filed on Dec. 31, 2003, 60/533,749, filed Dec. 31, 2003, 60/533,750, filed Dec. 31, 2003, 60/534,809, filed Jan. 7, 2004, 60/545,065, filed Feb. 17, 2004, all of which are incorporated herein by reference.

FIELD OF THE INVENTION

The present invention relates to electrical contacts and connectors designed and configured for transmitting power. At least some of the preferred connector embodiments include both power contacts and signal contacts disposed in a housing unit.

BACKGROUND OF THE INVENTION

Electrical hardware and systems designers are confronted with competing factors in the development of new electrical connectors and power contacts. For example, increased power transmission often competes with dimensional constraints and undesirable heat buildup. Further, typical power connector and contact beam designs can create high mating forces. When a high mating force is transferred into a connector housing structure, the plastic can creep, causing dimensional changes that can affect the mechanical and electrical performance of the connector. The unique connectors and contacts provided by the present invention strive to balance the design factors that have limited prior art performance.

SUMMARY OF THE PREFERRED EMBODIMENTS

The present invention provides power contacts for use in an electrical connector. In accordance with one preferred embodiment of the present invention, there has now been provided a power contact including a first plate-like body member, and a second plate-like body member stacked against the first plate-like body member so that the first and second plate-like body members are touching one another along at least a portion of opposing body member surfaces.

In accordance with another preferred embodiment of the present invention, there has now been provided a power contact including juxtaposed first and second plate-like body members that define a combined plate width. The first body member includes a first terminal and the second body member includes a second terminal. A distance between respective distal ends of the first terminal and the second terminal is greater than the combined plate width.

In accordance with yet another preferred embodiment, there has now been provided a power contact including opposing first and second plate-like body members. A set of pinching beams extends from the opposing plate-like body members for engaging a straight beam associated with a mating power contact. At least one straight beam also extends from the opposing plate-like body members for engaging an angled beam associated with the mating power contact.

In accordance with another preferred embodiment, there has now been provided a power contact including a first plate that defines a first non-deflecting beam and a first deflectable beam, and a second plate that defines a second non-deflecting beam and a second deflectable beam. The first and second plates are positioned beside one another to form the power contact.

The present invention also provides matable power contacts. In accordance with one preferred embodiment of the present invention, there has now been provided matable power contacts including a first power contact having opposing first and second plate-like body members and a second power contact having opposing third and fourth plate-like body members. At least one of the first and second body members and the third and fourth body members are stacked against each other.

In accordance with another preferred embodiment, there has now been provided matable power contacts including a first power contact having a pair of straight beams and a pair of angled beams, and a second power contact having a second pair of straight beams and a second pair of angled beams. The pair of straight beams are in registration with the second pair of angled beams; the pair of angled beams are in registration with the second pair of straight beams.

In accordance with yet another preferred embodiment, there has now been provided matable power contacts including first and second power contacts. The first power contact includes a body member, a deflecting beam extending from the body member, and a non-deflecting beam extending from the body member. The second power contact includes a second body member, a second deflecting beam extending from the second body member, and a second non-deflecting beam extending from the second body member. When the first and second power contacts are mated, the deflecting beam engages the second non-deflecting beam, and the non-deflecting beam engages the second deflecting beam, so that mating forces are applied in opposite directions to minimize stress in each of the first and second power contacts.

In accordance with another preferred embodiment, there has now been provided matable power contacts including a first power contact and a second power contact. Each of the first and second power contacts includes a pair of opposing non-deflecting beams and a pair of opposing deflectable beams.

The present invention further provides electrical connectors. Preferred electrical connectors may include the above-described power contacts. Additionally, and in accordance with one preferred embodiment of the present invention, there has now been provided an electrical connector including a housing and a plurality of power contacts disposed in the housing. Each of the power contacts has a plate-like body member including at least one of an upper section having a notch formed therein and a separate lower section adapted for fitting within the notch. Some of the power contacts are disposed in the housing such that adjacent power contacts include only one of the upper section and the lower section.

In accordance with another preferred embodiment, there has now been provided an electrical connector including a header electrical connector and a receptacle electrical connector. The header connector includes a header housing and a plug contact disposed in the header housing. The plug contact has a pair of plate-like body members and a plurality of beams extending therefrom. The receptacle connector includes a receptacle housing and a receptacle contact disposed in the receptacle housing. The receptacle contact has a second pair of plate-like body members and a second plurality of beams extending therefrom. The force required to mate the header electrical connector with the receptacle electrical connector is about 10N per contact or less.

In accordance with yet another preferred embodiment of the present invention, there has now been provided an electrical connector including a housing, a first power contact, and second power contact. The second power contact has an amperage rating this is higher than that of the first power contact.

BRIEF DESCRIPTION OF THE DRAWINGS

FIG. 34 is a perspective view of an exemplary connector that includes power and signal contact subassemblies shown in FIGS. 32 and 33, respectively.

FIG. 35 is a perspective view of an exemplary power contact having opposing plates that are stacked together in a first region and spaced apart in a second region.

DETAILED DESCRIPTION OF ILLUSTRATIVE EMBODIMENTS

Figure 1:
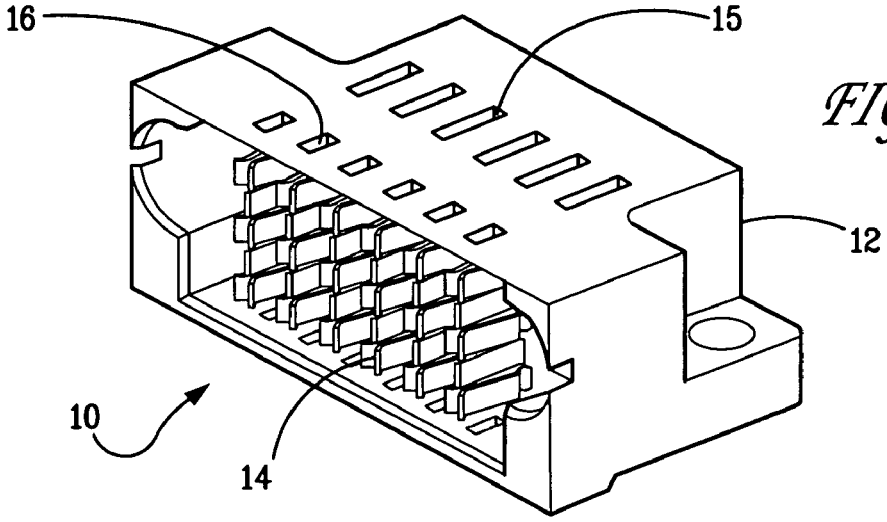
FIG. 1 is a front perspective view of an exemplary header connector provided by the present invention.
Figure 2:
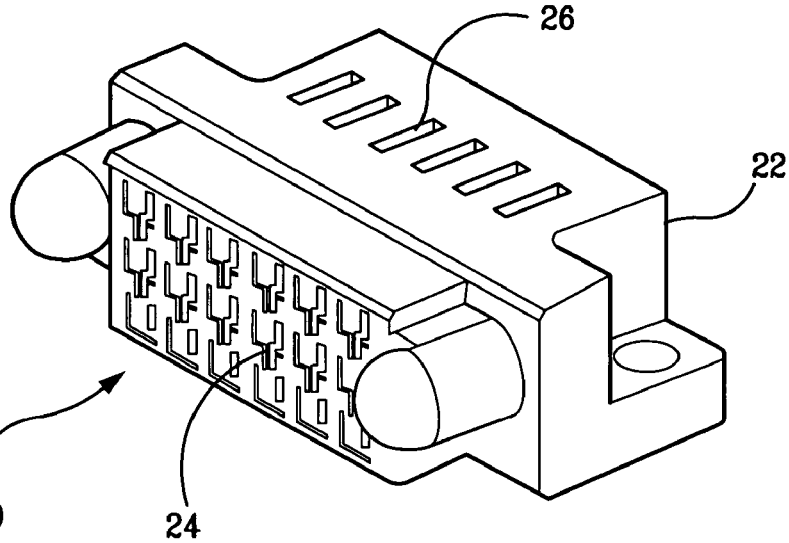
FIG. 2 is a front perspective view of an exemplary receptacle connector that is matable with the header connector shown in FIG. 1.

Referring to FIG. 1, an exemplary header connector 10 is shown having a connector housing 12 and a plurality of power contacts 14 disposed therein. Housing 12 optionally includes apertures 15 and 16 for enhancing heat transfer. Apertures 15 and 16 may extend into a housing cavity wherein the power contacts 14 reside, thus defining a heat dissipation channel from the connector interior to the connector exterior. An exemplary mating receptacle connector 20 is illustrated in FIG. 2. Receptacle connector 20 has a connector housing 22 and a plurality of power contacts disposed therein that are accessible through openings 24. Housing 22 may also employ heat transfer features, such as, for example, apertures 26. The connector housing units are preferably molded or formed from insulative materials, such as, for example, a glass-filled high temperature nylon, or other materials known to one having ordinary skill in the area of designing and manufacturing electrical connectors. An example is disclosed in U.S. Pat. No. 6,319,075, herein incorporated by reference in its entirety. The housing units of the electrical connectors may also be made from non-insulative materials.

Figure 3:
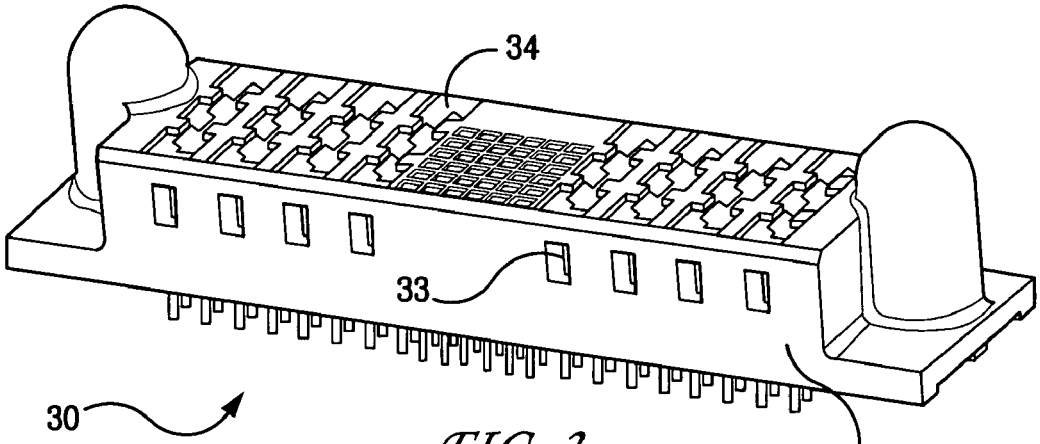
FIG. 3 is perspective view of an exemplary vertical receptacle connector including both power and signal contacts.
Figure 4:
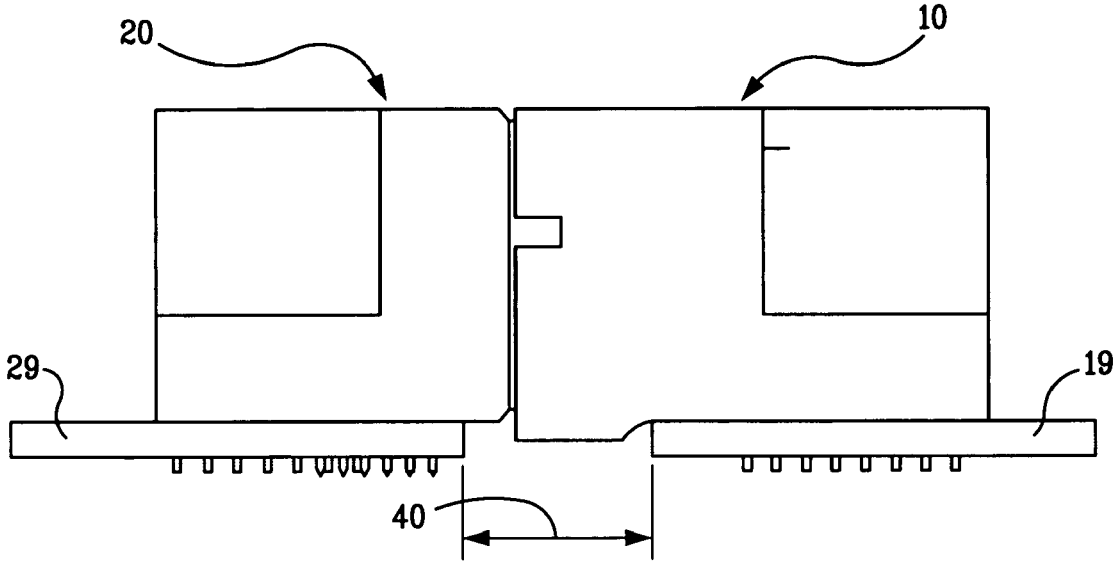
FIG. 4 is an elevation view of the header connector shown in FIG. 1 mated with the receptacle connector shown in FIG. 2.
Figure 5:
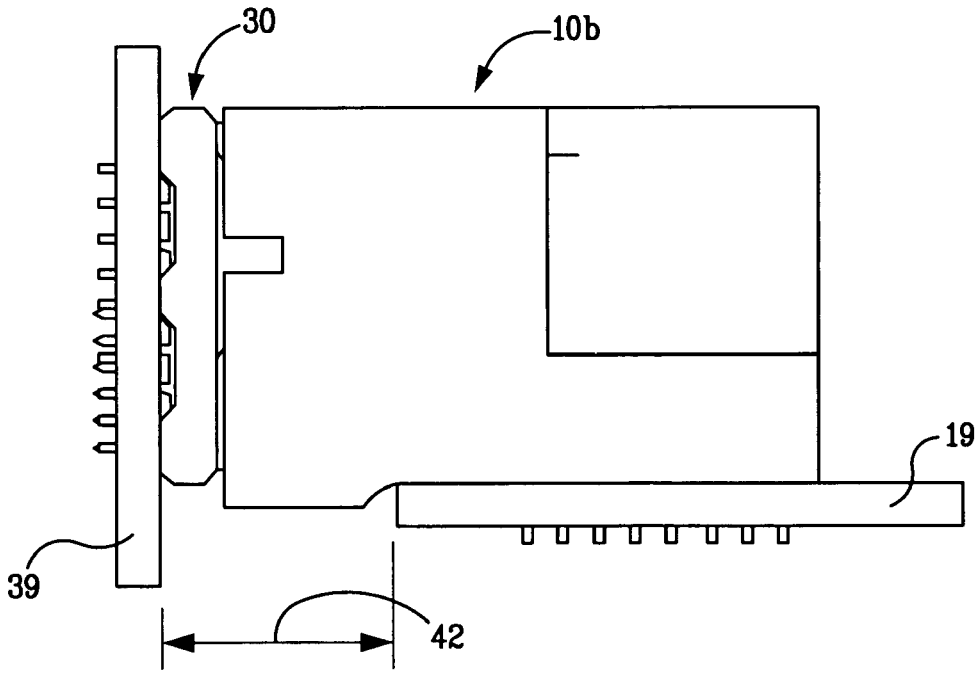
FIG. 5 is an elevation view of an exemplary header connector mated with the receptacle connector shown in FIG. 3.

Header connector 10 and receptacle connector 20 are both designed for a right angled attachment to a printed circuit structure, whereby the corresponding printed circuit structures are coplanar. Perpendicular mating arrangements are also provided by the present invention by designing one of the electrical connectors to have vertical attachment to a printed circuit structure. By way of example, a vertical receptacle connector 30 is shown in FIG. 3. Receptacle connector 30 comprises a housing 32 having a plurality of power contacts disposed therein that are accessible via openings 34. Connector 30 also comprises optional heat dissipation apertures 33. In both coplanar and perpendicular mating arrangements, it is beneficial to minimize the spacing between two associated printed circuit structures to which the connectors are attached. Header 10 is shown mated with receptacle 20 in FIG. 4. The electrical connectors are engaged with coplanar printed circuit structures 19 and 29. The edge-to-edge spacing 40 between printed circuit structures 19 and 29 is preferably 12.5 mm or less. A perpendicular mating arrangement with a header connector 10*b* and receptacle connector 30 is shown in FIG. 5. The edge-to-edge spacing 42 between printed circuit structure 19 and a printed circuit structure 39, to which vertical receptacle connector 30 is engaged, is again preferably 12.5 mm or less. Edge-to-edge spacing is about 9–14 mm, with 12.5 mm being preferred. Other spacings are also possible.

Figure 6:
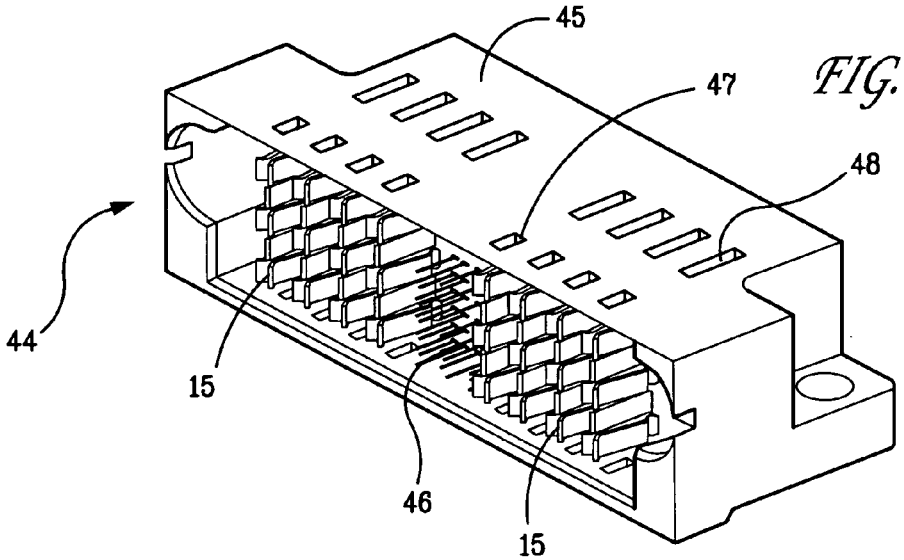
FIG. 6 is a front perspective view of another exemplary header connector in accordance with the present invention.
Figure 7:
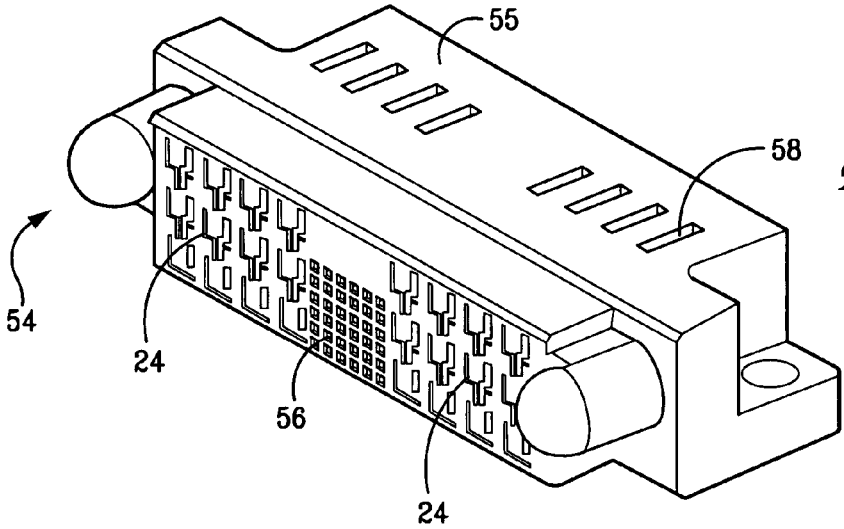
FIG. 7 is a front perspective view of a receptacle connector that is matable with the header connector shown in FIG. 6.

At least some of the preferred electrical connectors include both power and signal contacts. Referring now to FIG. 6, an exemplary header connector 44 is illustrated, having a housing 45, an array of power contacts 15, an array of signal contacts 46, and optional heat transfer apertures 47 and 48 formed in housing 45. A receptacle connector 54, which is suitable for mating with header 44, is shown in FIG. 7. Receptacle connector 54 includes a housing 55, an array of power contacts accessible through openings 24, an array of signal contacts accessible through openings 56, an optional heat transfer apertures 58 extending through housing 55.

Figure 8:
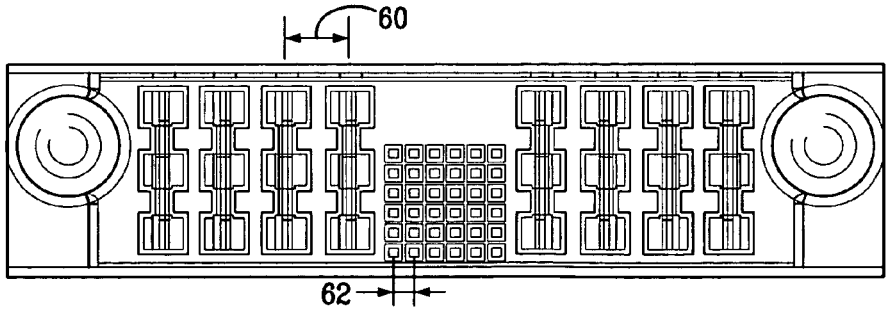
FIG. 8 is an elevation view of a receptacle connector illustrating one preferred centerline-to-centerline spacing for power and signal contacts.

Preferred connector embodiments are extremely compact in nature. Referring now to FIG. 8, centerline-to-centerline spacing 60 of adjacent power contacts is preferably 6 mm or less, and centerline-to-centerline spacing 62 of adjacent signal contacts is preferably 2 mm or less. Note that connectors of the present invention may have different contact spacing than this preferred range.

Figure 9:
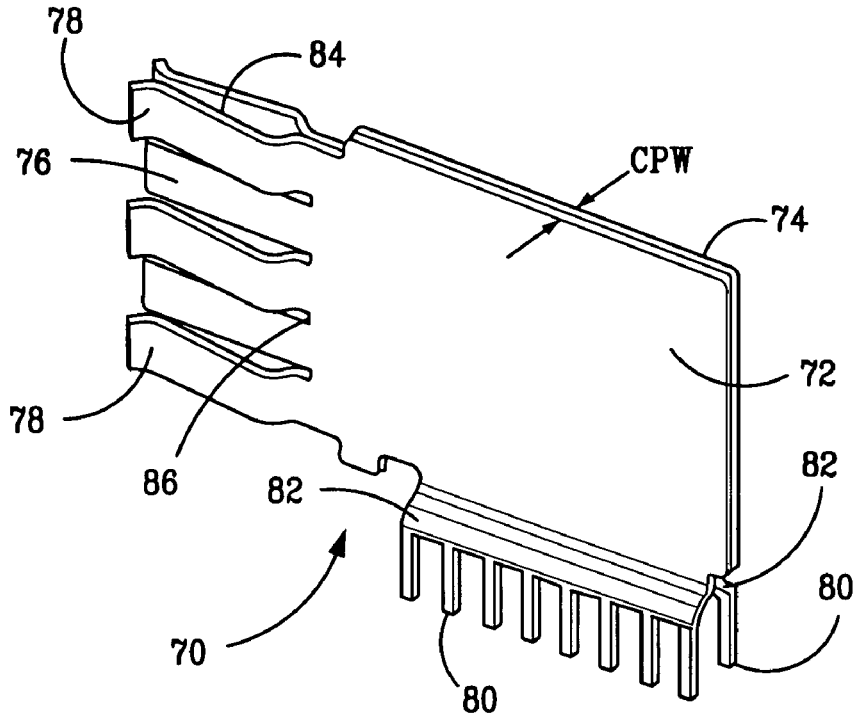
FIG. 9 is a perspective view of an exemplary power contact provided by the present invention.

A number of preferred power contact embodiments that are suitable for use in the above-described connectors will now be discussed. One preferred power contact 70 is shown in FIG. 9. Power contact 70 can be used in a variety of different connector embodiments, including, for example, header connector 10 shown in FIG. 1. Power contact 70 includes a first plate-like body member 72 (may also be referred to as a "plate") stacked against a second plate-like body member 74. A plurality of straight or flat beams 76 (also referred to as blades) and a plurality of bent or angled beams 78 alternatingly extending from each of the body members. The number of straight and bent beams may be as few as one, and may also be greater than that shown in the figures. With the body members in a stacked configuration, beams 78 converge to define "pinching" or "receptacle" beams. The contact beam design minimizes potential variation in the contact normal force over the life of the product through alternating opposing pinching beams. This beam design serves to cancel out many of the additive contact forces that would otherwise be transferred into the housing structure. The opposing pinching beams also aid in keeping the plate-like body members sandwiched together during mating complementary connectors. The contact design provides multiple mating points for a lower normal force requirement per beam, thus minimizing the damaging effect of multiple matings.

When power contact 70 is mated with a complementary power contact, beams 78 necessarily flex, deflect or otherwise deviate from their non-engaged position, while beams 76 remain substantially in their non-engaged position. Power contact 70 further includes a plurality of terminals 80 extending from a flared portion 82 of each of body members 72 and 74. The non-flared portions define a combined plate width CPW. Flared portion 82 provides proper alignment of terminals 80 with attachment features of a printed circuit structure, whereby in preferred embodiments, the distance between distal ends of opposing terminals is greater than combined plate width CPW. The terminals themselves may be angled outwardly so that a flared body portion is unnecessary to establish proper spacing when contact body members are stacked or otherwise positioned closely to one another (see, e.g., the terminals in FIG. 28). Flared portion 82 may also provide a channel for heat dissipation, predominantly via convection. Additional heat dissipation channels may be provided by a space 84 defined between beams 78, and a space 86 defined between adjacent beams extending from a contact body member.

Figure 10:
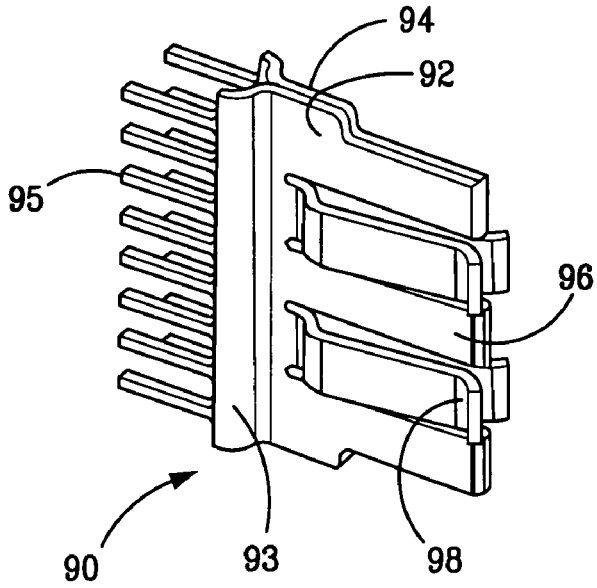
FIG. 10 is a perspective view of a power contact that is matable with the power contact shown in FIG. 9.
Figure 11:
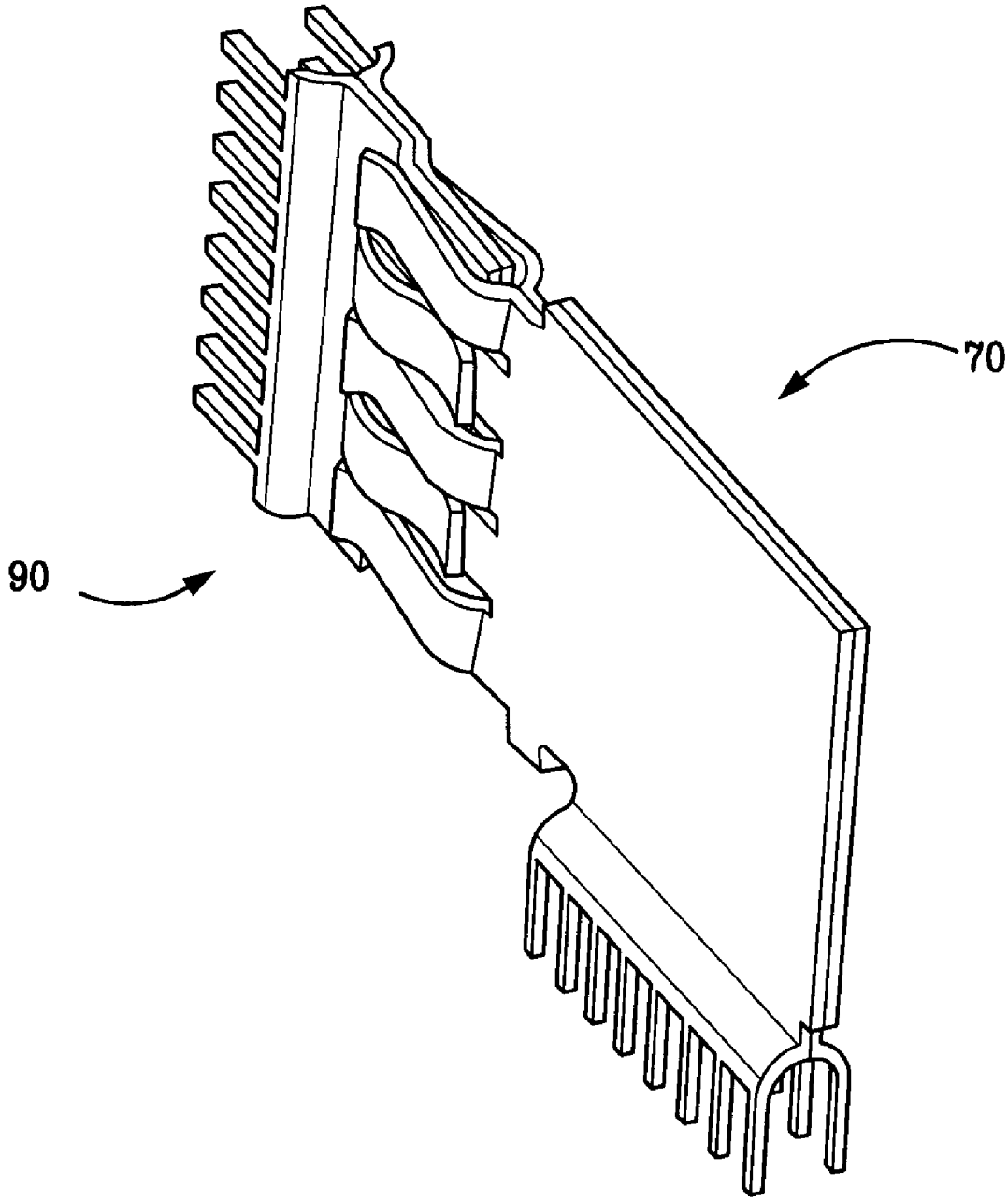
FIG. 11 is perspective view of the power contact shown in FIG. 9 being mated with the power contact shown in FIG. 10.

Referring now to FIG. 10, a power contact 90 is shown which is suitable for mating with power contact 70. Power contact 90 includes a pair of stacked plate-like body members 92 and 94. Straight beams 96 and angled beams 98 extend from the body members and are arranged so as to align properly with beams 78 and 76, respectively, of power contact 70. That is, beams 78 will engage beams 96, and beams 76 will engage beams 98. Each of body members 92 and 94 include a plurality of terminals 95 extending from flared portion 93 for electrically connecting power contact 90 to a printed circuit structure. Power contacts 70 and 90 are illustrated in a mated arrangement in FIG. 11.

Figure 12:
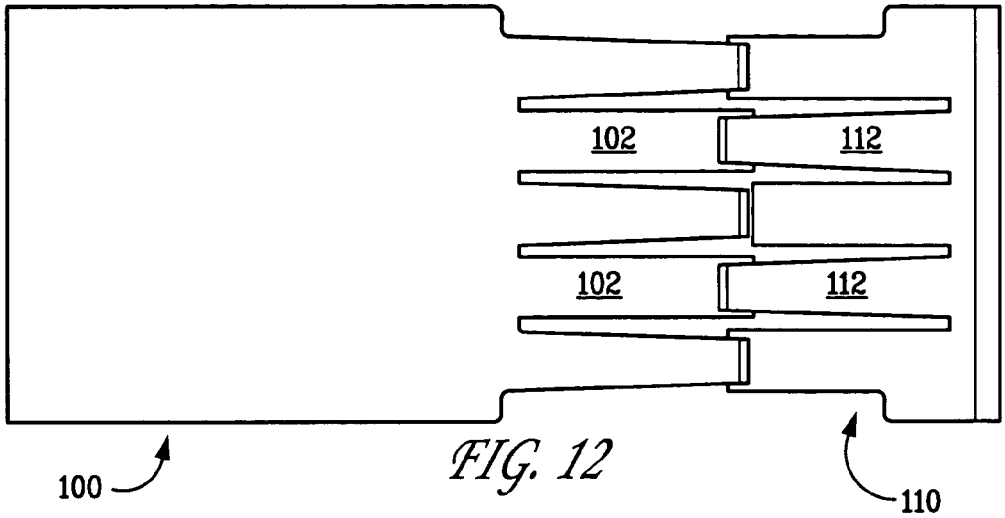
FIGS. 12–14 are elevation views of exemplary power contacts at three levels of engagement.
Figure 13:
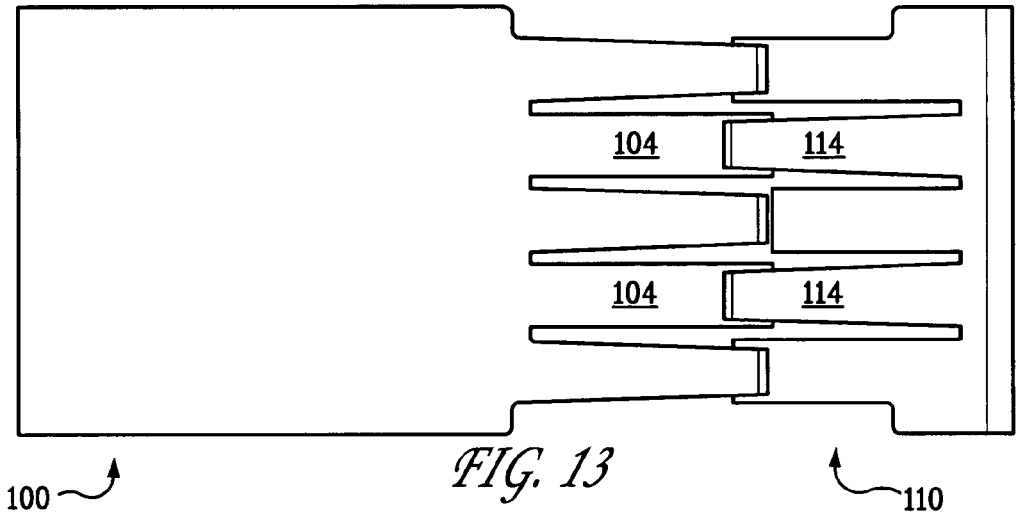
Figure 14:
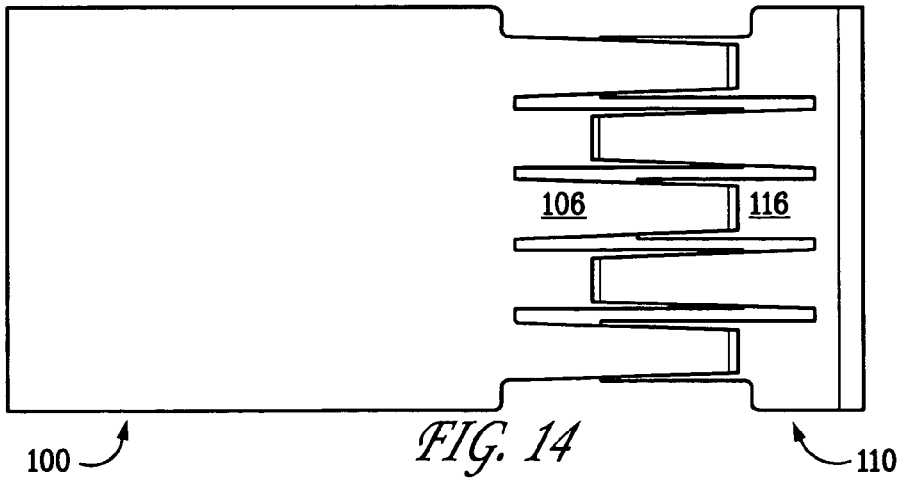

To reduce the mating force of complementary power contacts and electrical connectors housing the same, contact beams can have staggered extension positions via dimensional differences or offsetting techniques. By way of example, FIGS. 12–14 show illustrative power contacts 100 and 110 at different mating positions (or insertion distances) from an initial engagement to a substantially final engagement. In FIG. 12, representing a first level of mating, the longest straight beams or blades 102 of contact 100 engage corresponding pinching beams 112 of contact 110. The force at the first level of mating will initially spike due to the amount of force required to separate or deflect the pinching beams with insertion of the straight beams or blades. Thereafter, the mating force at the first level of mating is primarily due to frictional resistance of the straight and angled beams when sliding against one another. A second level of mating is shown in FIG. 13, wherein the next longest straight beams or blades 114 of contact 110 engage corresponding pinching beams 104 of contact 100. The mating force during the second level of mating is due to additional pinching beams being deflected apart and the cumulative frictional forces of engaged beams at both the first and second mating levels. A third level of mating is shown in FIG. 14, with the remaining straight beam or blade 116 of contact 100 engaging the remaining corresponding pinching beam 106 of contact 100. One of ordinary skill in the art would readily appreciate that fewer or greater levels of mating, other than three in a given power contact and in an array of power contacts within the same connector, is contemplated by the present invention. As noted above, electrical connectors of the present invention may employ both power and signal contacts. The signal contacts, can also be staggered in length with respect to one another and, optionally, with respect to the lengths of the power contacts. For example, the signal contacts may have at least two different signal contact lengths, and these lengths may be different than any one of the power contact lengths.

Figure 15:
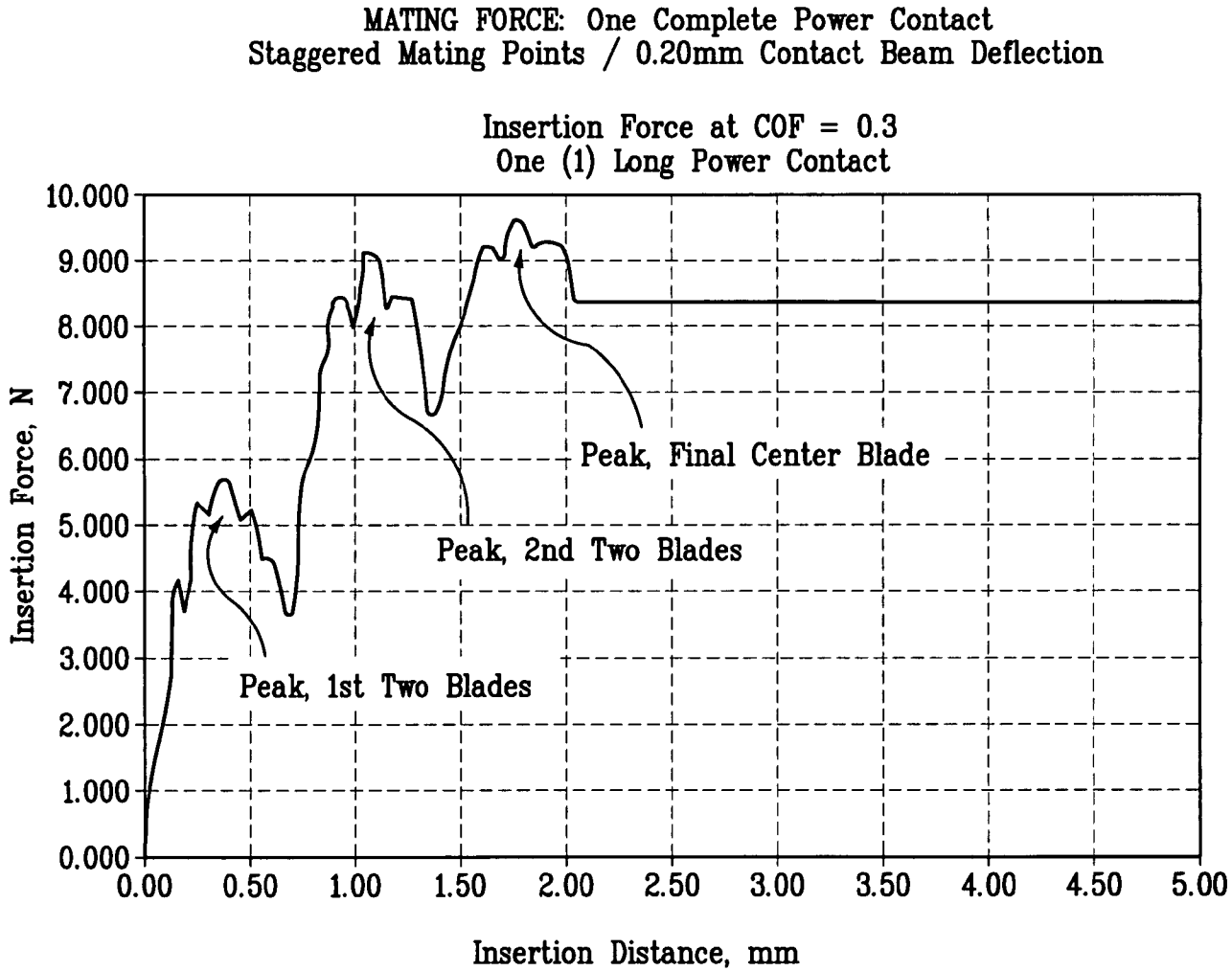
FIGS. 15–19 are graphs illustrating representative mating forces versus insertion distance for various exemplary power contacts provided by the present invention.
Figure 16:
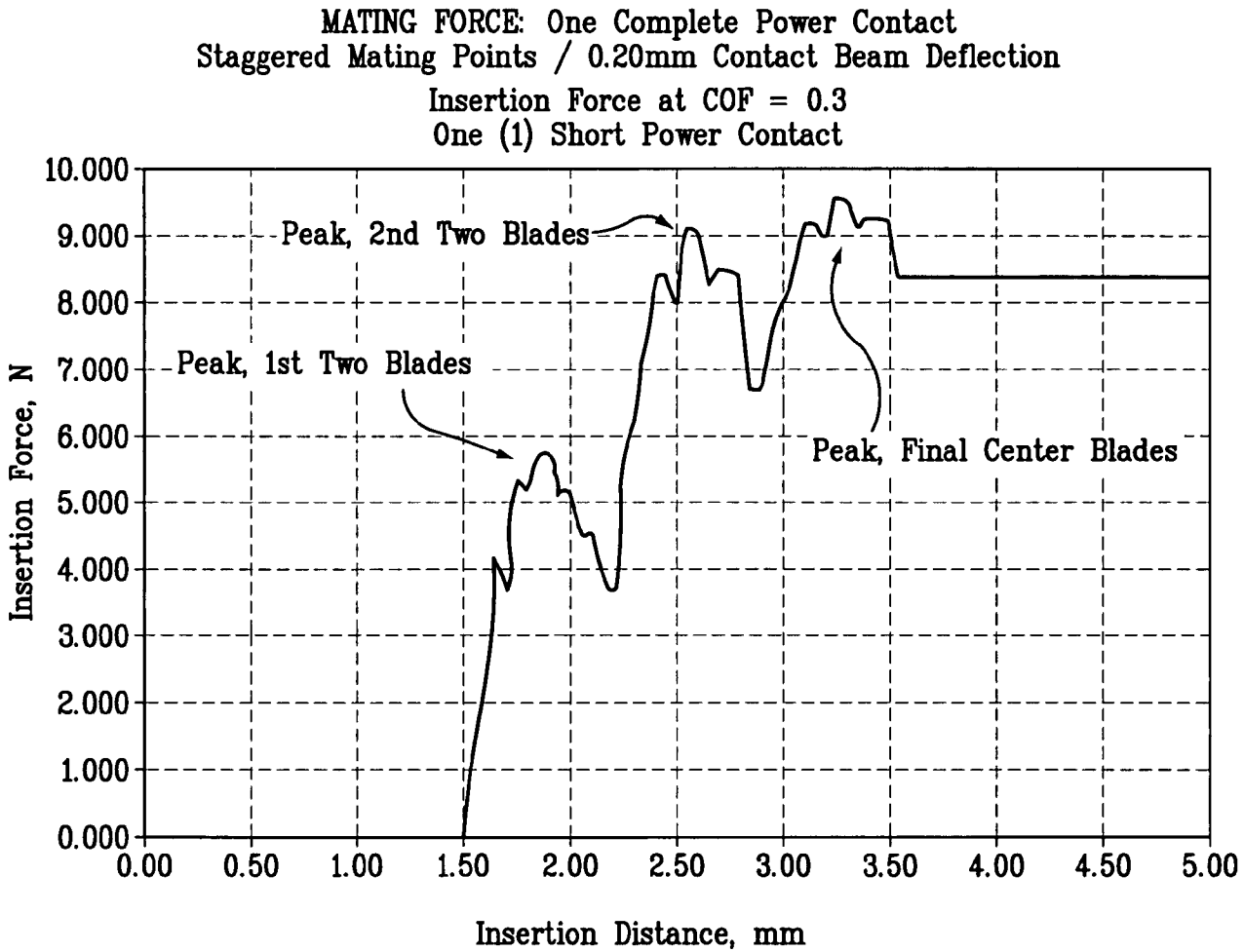
Figure 17:
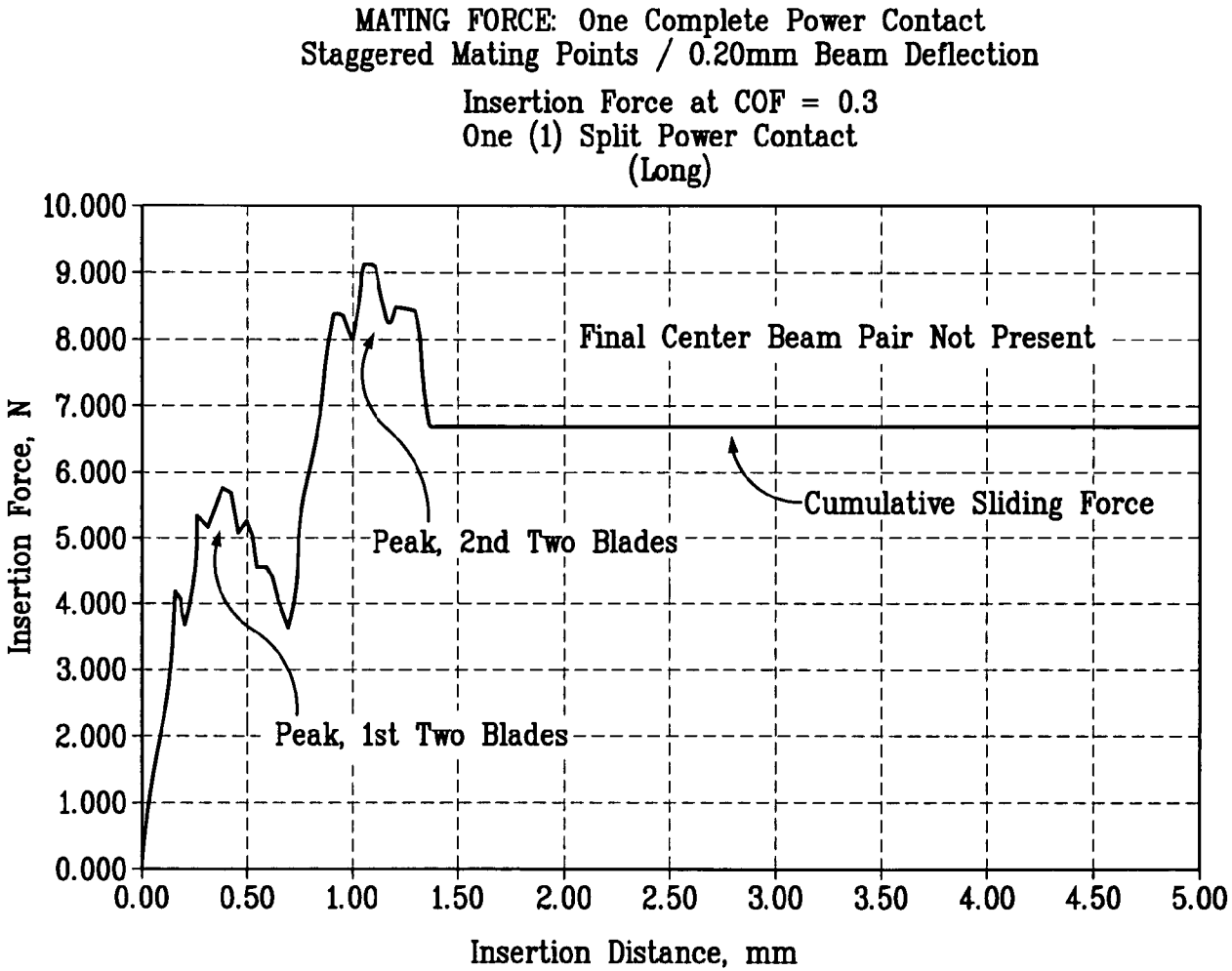
Figure 18:
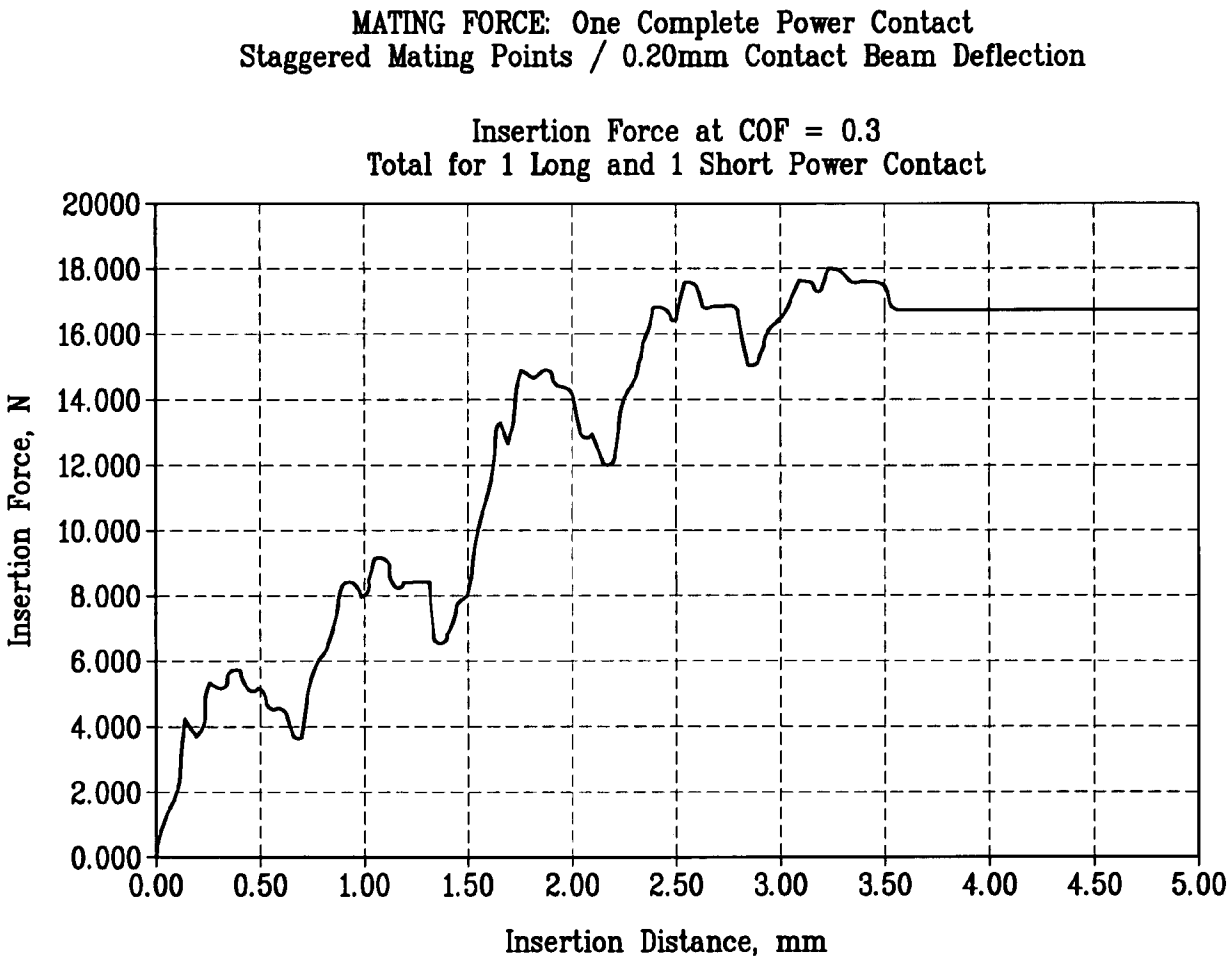
Figure 19:
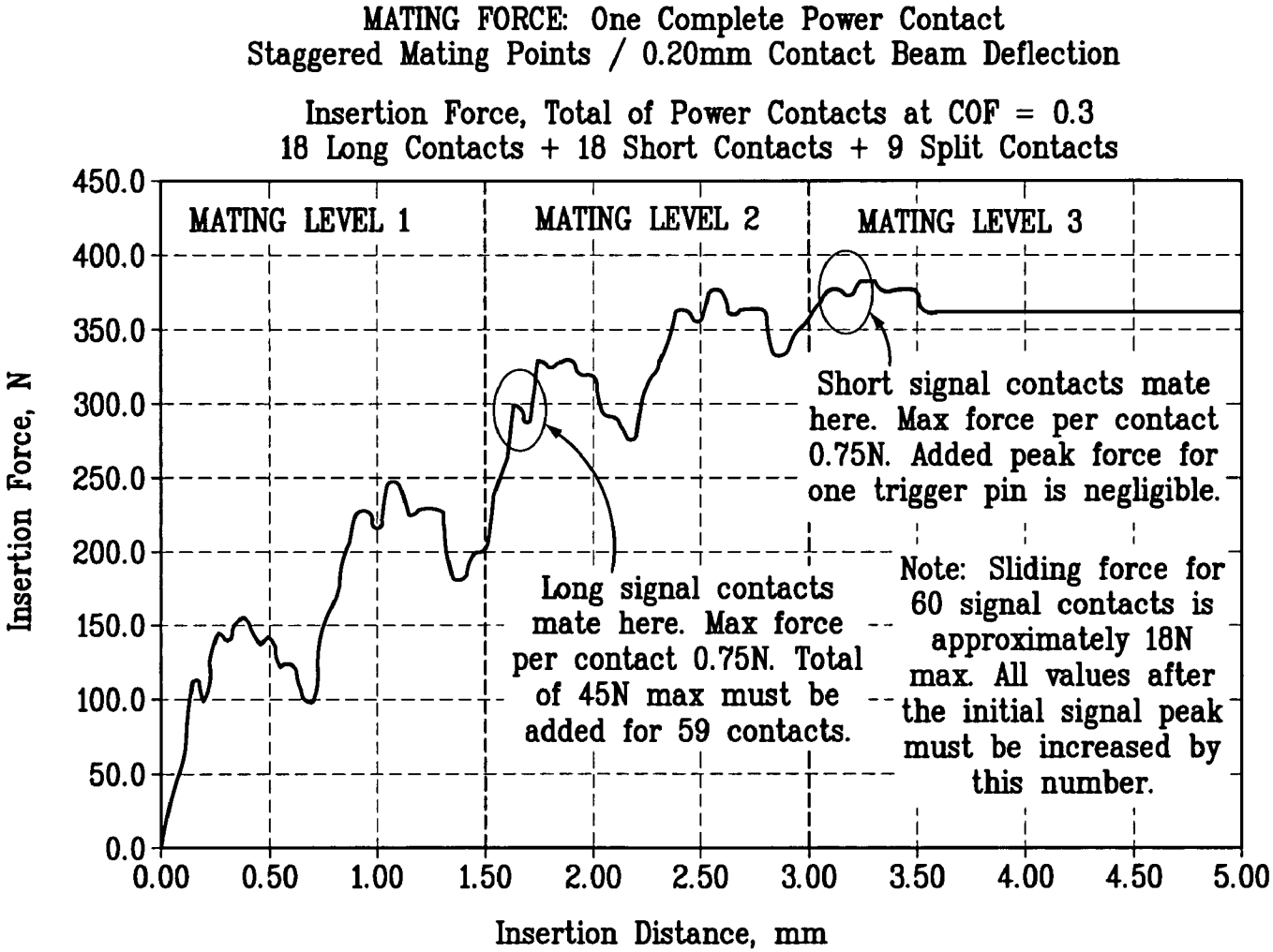

FIGS. 15–19 are graphs showing representative relationships of mating forces versus insertion distance for various exemplary power contacts (discussed above or below). Mating force for an exemplary power contact employing three levels of mating is shown in FIG. 15, with the peaks representing deflection of pinching beams with engaging straight beams at each mating level. If the power contact did not employ staggered mating, the initial force would essentially be 2.5 times the first peak of about 8N, or 14.5 N. With staggered mating points, the highest force observed throughout the entire insertion distance is less than 10 N.

It is apparent to one skilled in the art that the overall size of a power connector according to the present invention is constrained, in theory, only by available surface area on a bus bar or printed circuit structure and available connector height as measured from the printed circuit structure. Therefore, a power connector system can contain many header power and signal contacts and many receptacle power and signal contacts. By varying the mating sequence of the various power and signal contacts, the initial force needed to mate a header with a receptacle is lower when the two power connectors are spaced farther apart (initial contact) and increases as the distance between the connector header and connector receptacle decreases and stability between the partially mated header and receptacle increases. Applying an increasing force in relation to a decreasing separation between the connector header and connector receptacle cooperates with mechanical advantage and helps to prevent buckling of the connector header and receptacle during initial mating.

Figure 20:
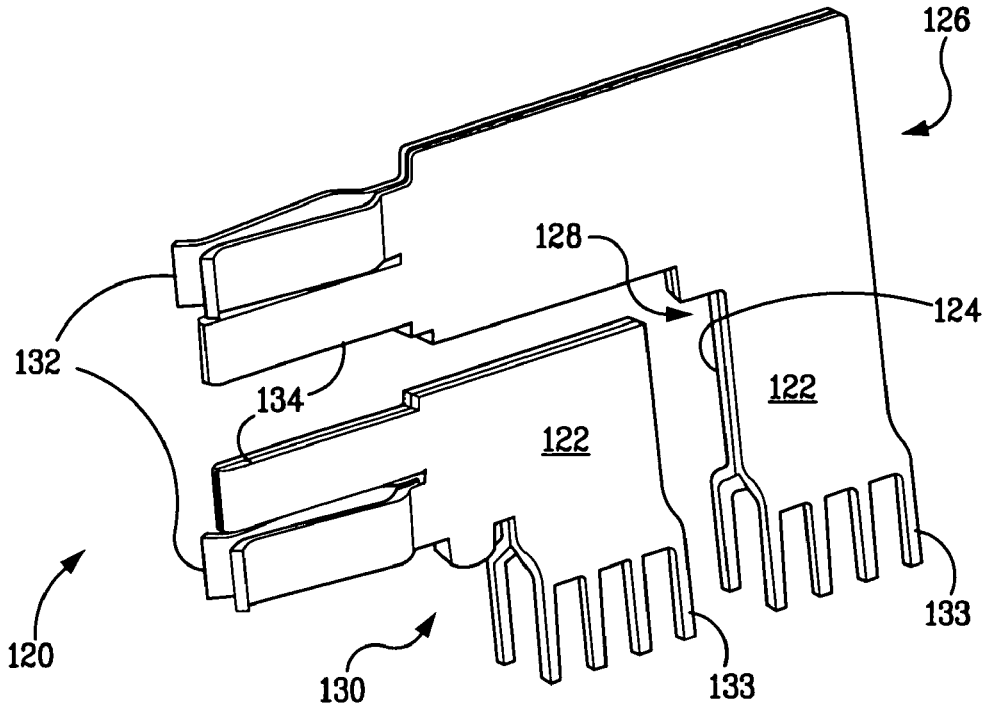
FIG. 20 is a perspective view of a split contact in accordance with the present invention.
Figure 21:
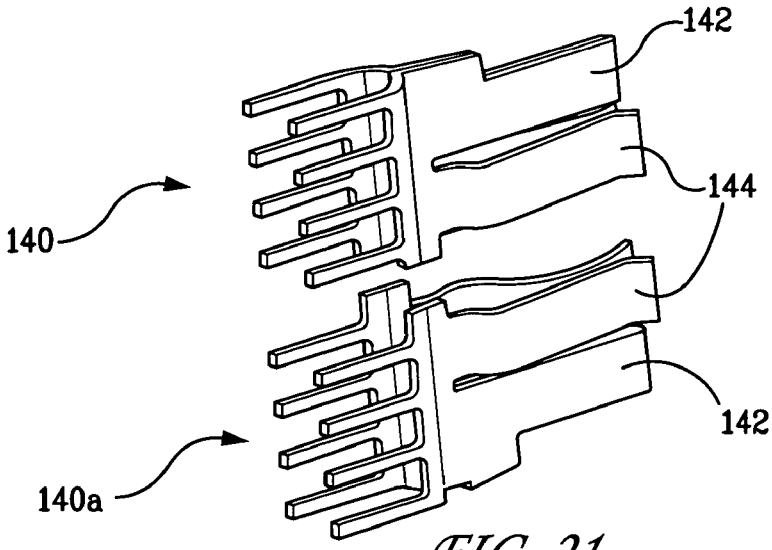
FIG. 21 is a perspective view of power contacts that are matable with the upper and lower sections of the split contact shown in FIG. 20.

Another exemplary power contact 120 is shown in FIG. 20. Power contact 120 comprises first and second plate-like body members 122 and 124. Power contact 120 can be referred to as a split contact that has an upper section 126 with a notch 128 formed therein for receiving a lower section 130. Upper section 126 is shown having an L-shape; however, other geometries can equally be employed. Lower section 130 is designed to substantially fit within notch 128. As shown, upper section 126 and lower section 130 each have a pair of angled beams 132 and a pair of straight beams 134 extending from a front edge, and a plurality of terminals 133 for engaging a printed circuit structure. The number and geometry of the beams can vary from that presented in the figures. FIG. 21 shows a pair of nearly identical power contacts 140, 140*a* in parallel that are suitable for mating with the upper and lower sections of split contact 120. Each power contact 140, 140*a* has a pair of straight beams 142 that can be inserted between the converging angled beams 132 of contact 120, and a pair of converging angled beams 144 for receiving straight beams 134 of contact 120.

Figure 22:
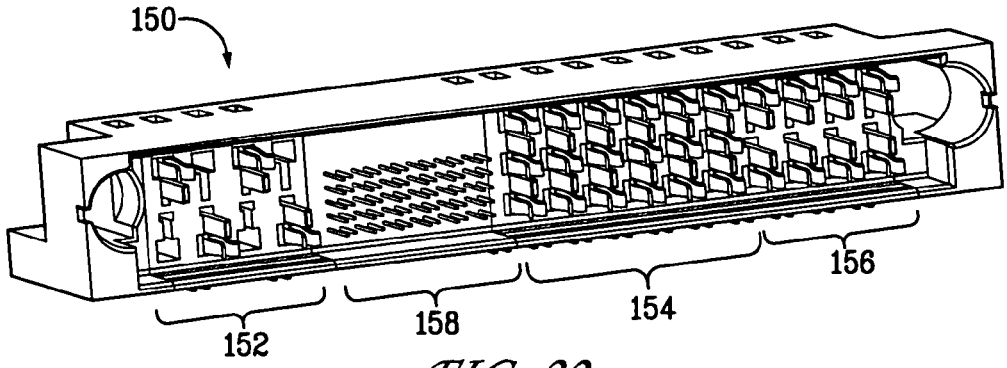
FIG. 22 is perspective view of a header connector comprising power contacts of varying amperage rating.

Note that for a single contact position, as shown in FIG. 22, electrical connectors of the present invention may also employ only one of the upper or lower sections. By alternating upper and lower contacts in adjacent contact positions, extra contact-to-contact clearance distance can be achieved, permitting the contact to carry a higher voltage of around 350V compared to the 0–150V rating associated with the aforementioned contacts shown in FIGS. 9 and 10 and FIGS. 20 and 21 based on published safety standards. The void area 160 left from the non-existing contact section of an associated split contact may provide a channel for dissipating heat. When used in the context of the overall connector assembly, the full contact, the split contact, and the upper or lower section of the split contact, can be arranged such that a variety of amperage and voltage levels can be applied within one connector. For example, exemplary connector 150, shown in FIG. 22, has an array of upper and lower contact sections 152 arranged for high voltage as noted, an array of full contacts 154 capable of approximately 0–50 A, an array of split contacts 156 capable of approximately 0–25A in reduced space, as well as an array of signal contacts 158. The number of different amperage power contacts can be less than or greater than three. Also, the arrangement of power and signal contacts can vary from that shown in FIG. 22. Lastly, the amperage rating for the different power contacts can vary from that noted above.

Figure 23:
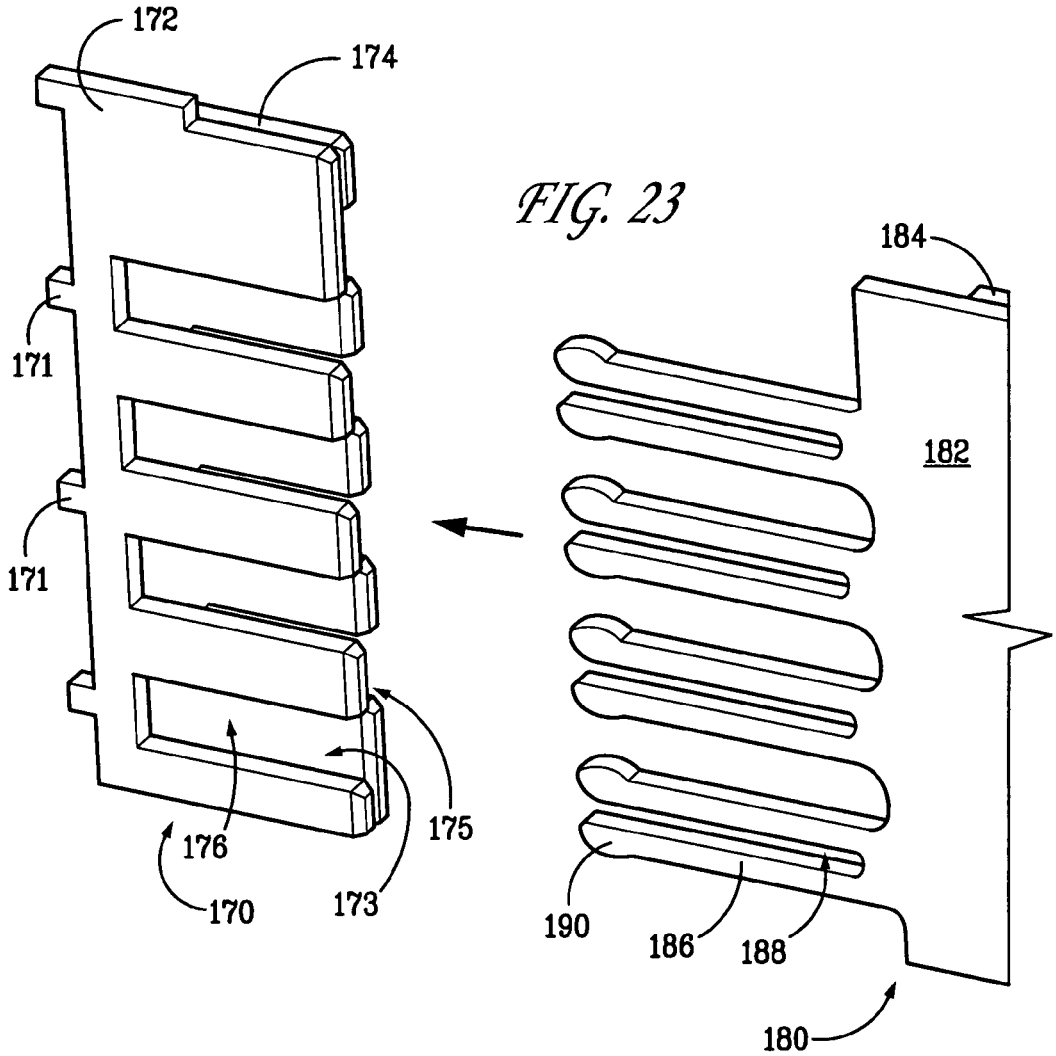
FIG. 23 is a perspective of additional matable power contacts provided by the present invention.

Referring now to FIG. 23, additional matable power contact embodiments are shown. Receptacle power contact 170 comprise a first plate-like body member 172 stacked against a second plate-like body member 174. Each of the first and second plate-like body member includes a series of notches 173 and 175, respectively. Preferably, notch series 173 is out of phase with notch series 175. A plurality of contact receiving spaces 176 are defined by the notches of one plate-like body member and a solid portion of the other plate-like body member. Contact receiving spaces 176 are designed to accept beams from mating plug contacts, such as for example, plug contact 180. At least one of the first and second plate-like body member further includes terminals 171 for attachment to a printed circuit structure. In an alternative receptacle contact embodiment (not shown), a single plate-like body member is employed having a series of notches on its outer surfaces, wherein the notches have a width less than that of the single plate-like body member.

Plug contact 180 comprise a first plate-like body member 182 stacked against a second plate-like body member 184. Each of the first plate-like body member and the second plate-like body member has a plurality of extending beams 186 for engagement with contact receiving spaces 176. As shown, a pair of beams 186 are dedicated for each individual contact receiving space 176 of the mating receptacle contact 170. Multiple single beams may equally be employed. Each pair of beams 186 includes a space 188 that may enhance heat transfer. Beams 186 are compliant and will flex upon engagement with contact receiving spaces 176. Beams 186 may optionally include a bulbous end portion 190. Contact body members 182 and 184 are shown in an optional staggered arrangement to provide a first mate-last break feature.

Figure 24:
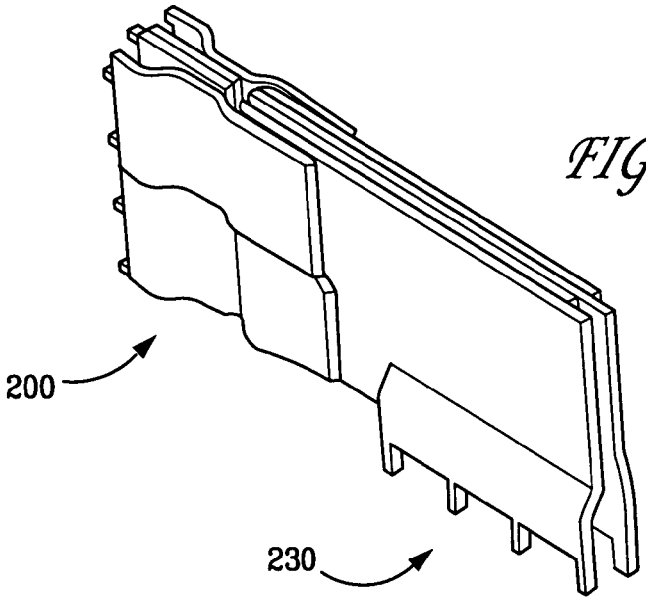
FIGS. 24–26 are perspective views of matable power contacts, each of which includes four stacked body members.
Figure 25:
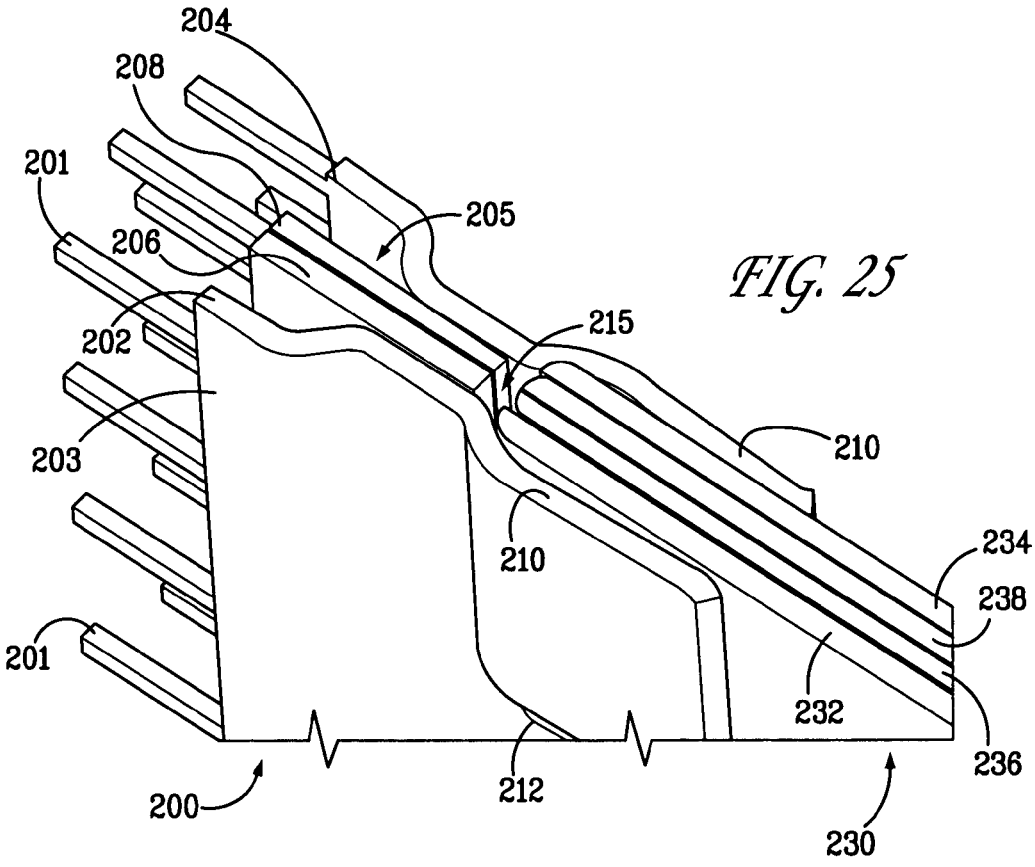
Figures 26, 27:
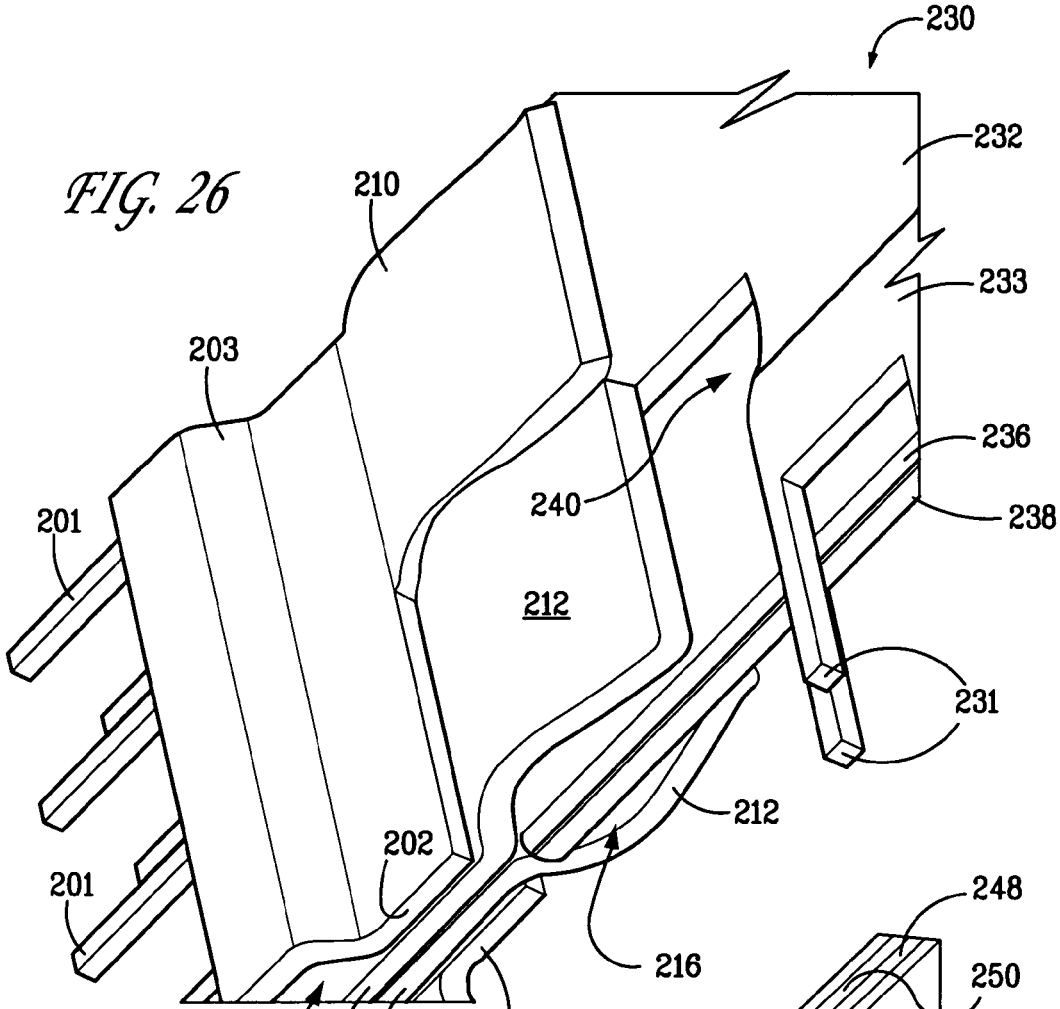
FIG. 27 is a perspective view of another power contact employing four stacked body members.

Although the power contacts discussed above have included two plate-like body members, some power contact embodiments (not shown) provided by the present invention include only a single plate-like body member. And other power contact designs of the present invention include more than two plate-like body members. Exemplary receptacle and plug contacts 200 and 230, respectively, are shown in FIGS. 24–26. Each of receptacle contact 200 and plug contact 230 employs four plate-like body members.

Receptacle power contact 200 includes a pair of outer plate-like body members 202 and 204, and a pair of inner plate-like body members 206 and 208. The outer and inner pairs of plate-like body members are shown in a preferred stacked configuration; that is, there is substantially no space defined between adjacent body members along a majority of their opposing surfaces. A plurality of terminals 201 extend from one or more of the plate-like body members, and preferably from all four of the body members. Each of the pair of outer plate-like body members 202, 204 includes a flared portion 203. Flared portion 203 provides proper spacing for terminal attachment to a printed circuit structure and may aid heat dissipation through a defined space 205. A first pair of beams 210 extends from outer body members 202, 204, and a second pair of beams 212 extends from inner body members 206, 208. In a preferred embodiment, and as shown, the first pair of beams 210 is substantially coterminous with the second pair of beams 212. In alternative embodiments, beams 210 and 212 extend to different positions to provide varied mating sequencing. Beams 210, 212 are designed and configured to engage features of mating plug contact 230, and may further define one or more heat dissipation channels between adjacent beams 210, 212, and heat dissipation channels 215 and 216 defined by opposing beams 210 and 212 themselves. Beams 210 and 212 are shown in a "pinching" or converging configuration, but other configurations may equally be employed. The outer and inner pairs of body members may employ additional beams other than that shown for engaging a plug power contact.

Plug contact 230 also has a pair of outer plate-like body members 232 and 234, and a pair of inner plate-like body members 236 and 238. Similar to the receptacle contact, each of the outer plate-like body members 232, 234 includes a flared portion 233 to provide proper spacing for terminals 231 extending from the body members. Outer plate-like body members 232, 234 preferably comprise a cutout section 240. Cutout section 240 exposes a portion of the inner plate-like body members 236, 238 to provide accessibility for engagement by mating receptacle power contact 200, and may aid heat dissipation, such as by convection. By way of example and as shown in FIG. 26, beams 210 of receptacle contact 200 are pinching the exposed portion of inner plate-like body members 236 and 238 of plug contact 230.

Another exemplary power contact 241 employing four stacked body members is shown in FIG. 27. Power contact 241 has a pair of outer plate-like body members 242 and 244, each of which has a plurality of straight cantilevered beams 246 extending from a front edge. Power contact 240 also has a pair of inner plate-like body members 248 and 250 that reside between outer plate-like body members 242 and 244. Inner plate-like body members 248 and 250 have a plurality of angled cantilevered beams 252 that converge to define pinching or receptacle beams. The straight beams 246 are spaced apart to permit the angled beams 252 to be disposed therebetween. A preferred matable power contact (not shown) would have a similar structure with pinching beams in registration with beams 246 and straight beams in registration with beams 252. During mating forces encountered by beams 246 would tend to hold outer plate-like body members 242 and 244 together, while forces encountered by beams 252 would tend to push the inner plate-like body members 248 and 250 apart. Collectively the forces would negate one another to provide a stable stack of plate-like body members with a minimal amount of force transferred to a carrier housing. Outer plates 242 and 244 would also tend to hold inner plates 248 and 250 together.

Each of the power contact embodiments shown and described thus far have employed multiple plate-like body members stacked against each other. In this stacked arrangement, the body members touch one another along at least a portion of opposing body member surfaces. The figures show the plate-like body members touching one another along a majority of their opposing surfaces. However, alternative contact embodiments contemplated by the present invention have a minority of their opposing surfaces touching. For example, an exemplary contact 253 is shown in FIG. 35 having a pair of plate-like body members 254 and 255. Contact 253 includes a first region 256 wherein the plate-like body members are stacked against each other, and a second region 257 wherein the body members are spaced apart. The first and second regions 256, 257 are interconnected by an angled region 258. Second region 257 includes a medial space 259 that can facilitate heat dissipation through convection, for example. Note that portions of the plate-like body members that are stacked and that are spaced apart can vary from that shown in FIG. 35. Rather than being stacked to any degree, multiple plate-like body members may also be spaced apart completely so as to define a medial space between adjacent contact body members. The medial space can facilitate heat transfer. Furthermore, one of the mating contacts can have stacked plate-like body member while the other does not-an example of such is shown with the matable contacts 260 and 290 shown in FIGS. 28 and 29, respectively, and described below.

Figure 28:
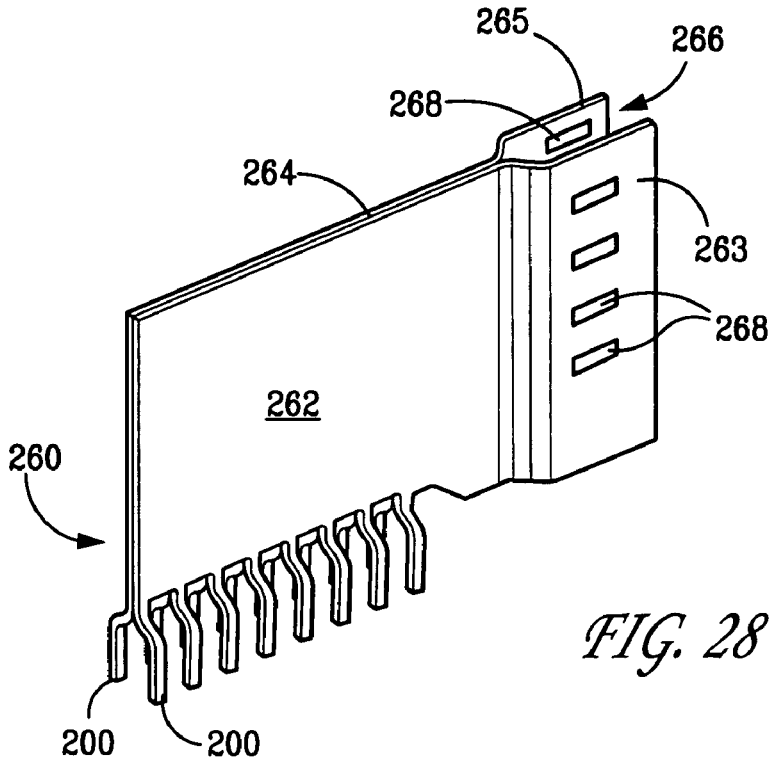
FIG. 28 is a perspective view of power contact embodiment having stacked body members with flared regions that collectively define a contact-receiving space.

Contact 260, shown in FIG. 28, includes a first plate-like body member 262 stacked against a second plate-like body member 264 along a majority of their inner surfaces. Front sections 263, 265 of each of the plate-like body members flare outwardly to define a contact receiving space 266 for engaging mating contact 290 (shown in FIG. 29). Optional apertures 268 are illustrated in flared front sections 263, 265 that may improve heat dissipation.

Contact 290 includes juxtaposed body members 292 and 294, which are preferably spaced apart from one another to define a medial space 296 therebetween. Surface area of body members 292, 294, in combination with medial space 296, allows for heat dissipation, predominantly via convection. A plurality of compliant beams 300, 302 extend from respective juxtaposed body members 292, 294. In one preferred embodiment, beams 300, 302 extend alternatingly from body members 292 and 294. Each of beams 300, 302 has a proximal portion 304 and a distal portion 306. Opposing side portions 308 and 310 are connected by a connecting portion 312, all of which is disposed between the proximal and distal portions 304 and 306. Connecting portion 312 preferably defines a closed beam end that is positioned away from body members 292, 294. Collectively, the foregoing beam portions define a bulb-shaped (or arrow-shaped) beam that provides at least two contact points per each individual beam 300, 302. Although all of contact beams 300, 302 are shown to be identical in size and geometry, the present invention also contemplates multiple beams that are different from one another, varying along one of the body members, as well as varying from body member to body member. The number of beams shown in FIG. 29 can also be altered to include more beams or fewer beams.

Figure 29:
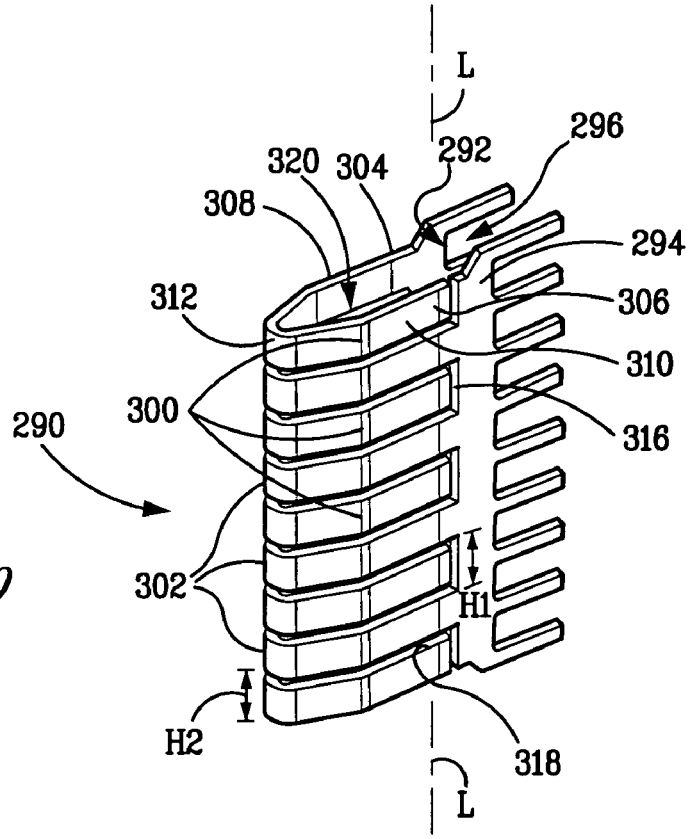
FIG. 29 is a perspective view of a power contact that is insertable into the contact-receiving space of the power contact shown in FIG. 28.

As shown in FIG. 29, distal portion 306 of each beam 300, 302 is spaced apart from the body member from which it does not extend, so that a split 316 is defined. Split 316 helps permit deflection of beams 300, 302 upon insertion into contact receiving space 266. A space 318 is also defined between adjacent beams 300, 302 on each of body members 292, 294. Space 318 has a height H1 that is preferably equal to or greater than a height H2 of the beams 300, 302, such that beams 300 of one body member 292 can be intermeshed with beams 302 of the other body member 294.

Split 316 and spaces 296, 318, and 320 allow heat to dissipate from the body members and compliant beams. In FIG. 29, contact 290 extends along an imaginary longitudinal axis L that lies coincident with the plane P of the page. In the FIG. 29 configuration, heat will dissipate by convection generally upward and along the imaginary longitudinal axis L. The beams 300, 302 and body member 292, 294 define a psuedo-chimney that helps channel heat away from contact 290. If contact 290 is rotated ninety degrees within the plane P of the page, heat can still dissipate through spaces 316 and 318, as well as through open ends of spaces 296 and 320.

Figure 30:
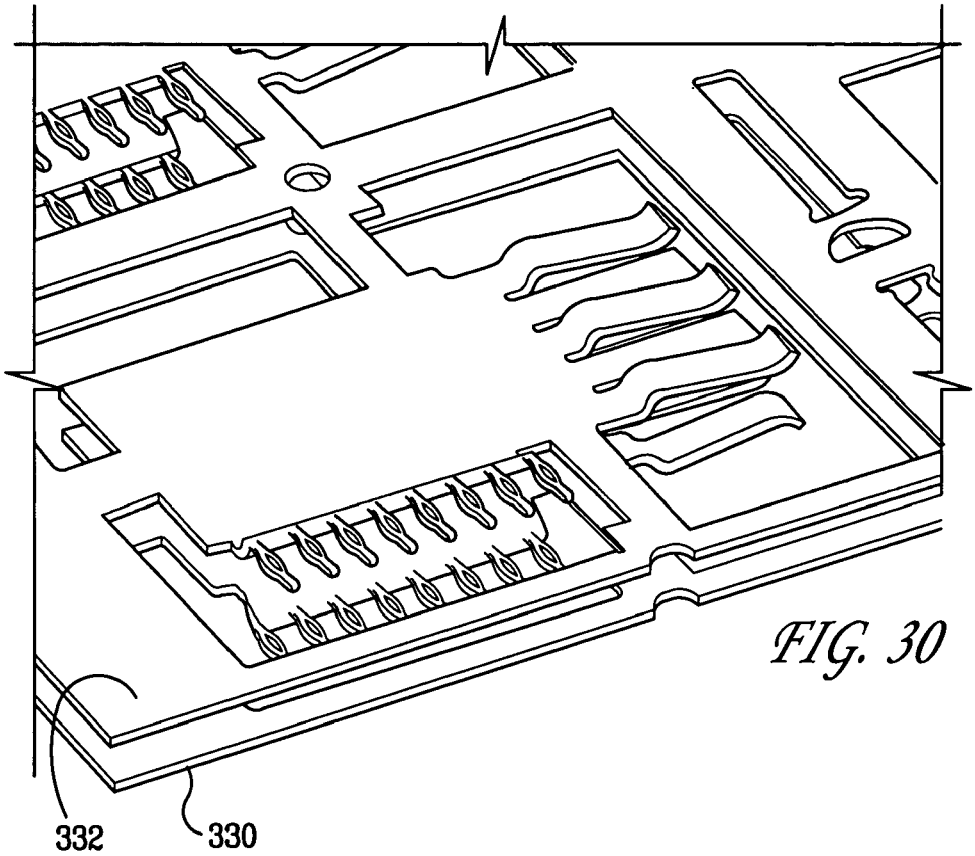
FIG. 30 is a perspective view of stamped strips of material for forming power contacts of the present invention.

Preferred contacts of the present invention may be stamped or otherwise formed from a strip of suitable material. The contacts may be formed individually, or alternatively formed in groups of two or more. Preferably, a strip of material is die-stamped to define multiple contact features in a pre-finished or finished form. Further manipulation may be needed after the die-stamping operation, such as, for example, coupling features together or altering a feature's originally stamped orientation or configuration (e.g., bending cantilevered beams or contact body portions). Referring to FIG. 30, exemplary strips 330 and 332 are shown, each of which has multiple plate-like body members that include straight and bent beams (preferably formed after the stamping operation) and a plurality of terminals extending therefrom. Where a power contact has first and second body members, both the left and right configurations may be stamped and provided in a single strip.

Figure 31:
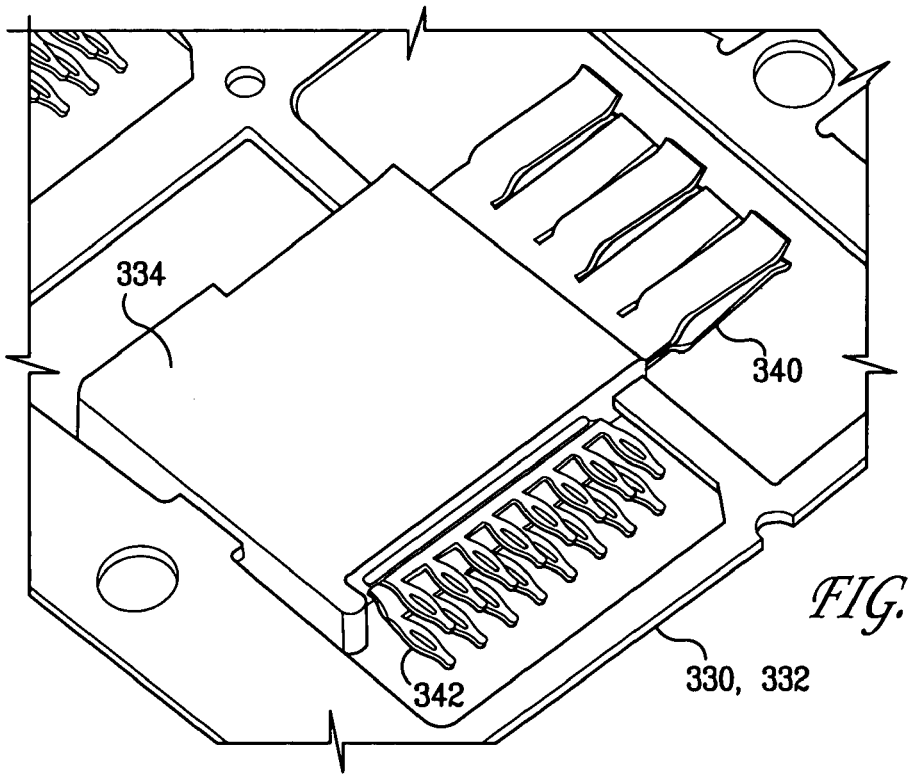
FIG. 31 is a perspective view of the stamped strips of material shown in FIG. 30 that include overmolded material on portions of the stamped strips.
Figure 32:
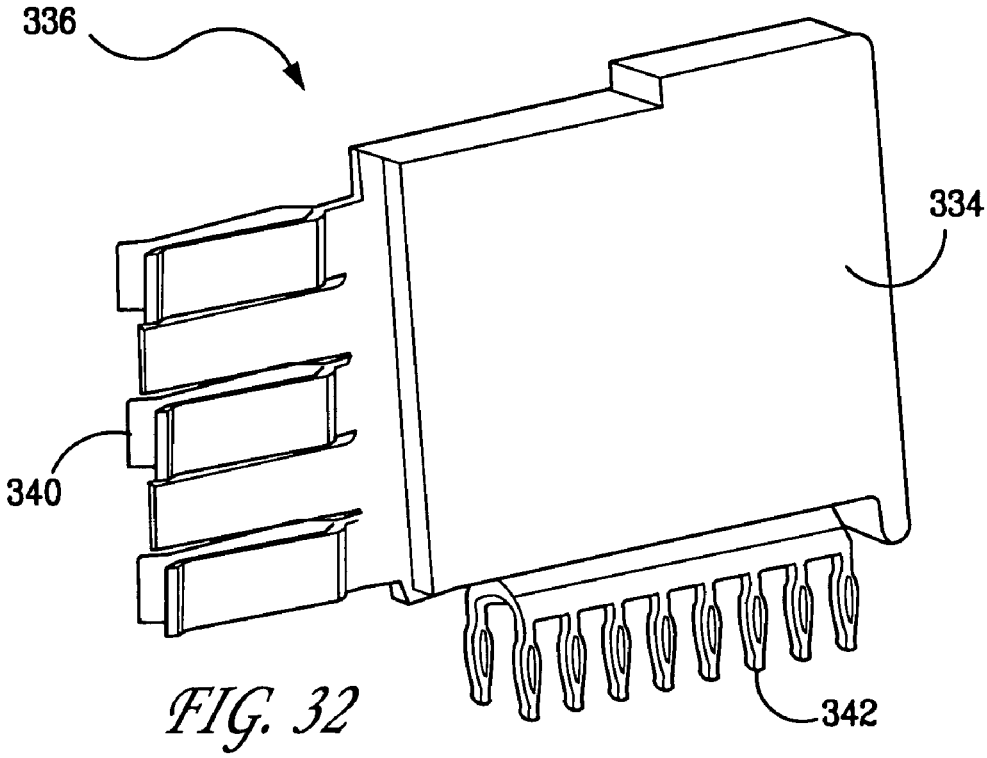
FIG. 32 is a perspective view of a power contact subassembly that has been separated from the strips of material shown in FIG. 31.
Figure 33:
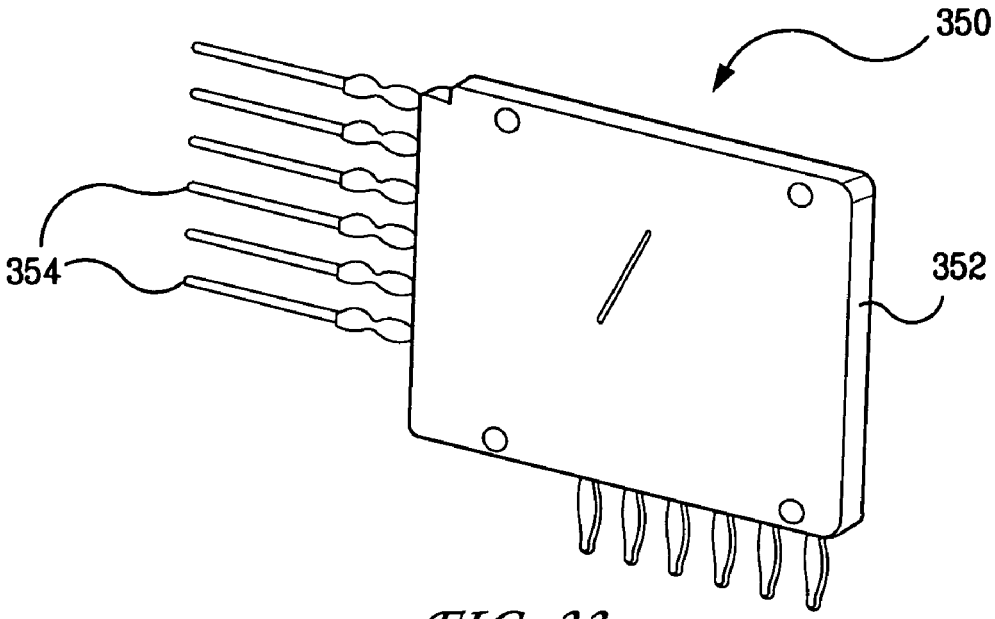
FIG. 33 is a perspective view of a signal contact subassembly in accordance with the present invention.

Individual contact elements can be separated from the remaining structure of strips 330 and 332, and then inserted into connector housings. In an alternative technique, the strips can be stacked together and then placed into a mold for creating overmolded contact subassemblies. A single strip could also be used where a contact employs only a single body member. And more than two strips could be stacked and be overmolded. Suitable thermoplastic material is flowed and solidified around a majority of the stacked body members to form a plastic casing 334, as is shown in FIG. 31. The contact subassembly 336 is then separated from the strips, as can be seen in FIG. 32. Beams 340 extend from casing 334 to engage a mating power contact, and terminals 342 extend from casing 334 for attaching the overmolded contact to a printed circuit structure. Signal contact subassemblies can also be made by overmolding a series of signal contacts, either in a strip form or individually. For example, an overmolded signal contact subassembly 350 is shown in FIG. 33, including a casing 352 and a series of signal contacts 354. FIG. 34 shows an exemplary electrical connector 360 having a housing 362, two power contact subassemblies 336 and multiple signal contact subassemblies 350.

Power and signal contacts of the present invention are made from suitable materials known to the skilled artisan, such as, for example, copper alloys. The contacts may be plated with various materials including, for example, gold, or a combination of gold and nickel. The number of contacts and their arrangement in connector housings is not limited to that shown in the figures. Some of the preferred power contacts of the present invention comprise plate-like body members stacked against each other. Stacking the body members allows a connector to carry extra current because of the added cross sectional area (lower resistance) and has the potential for added surface area that can facilitate convective heat transfer. One of ordinary skill in the art would readily appreciate that the plate-like body members may be planar or non-planar in form. The present invention also includes juxtaposing plate-like body members, such that the body members are spaced apart to define a medial space therebetween. The medial space can also enhance heat transfer, predominantly via convection. The contact plate-like body members may also contain apertures or other heat transfer features. The housing units of electrical connectors provided by the present invention may also contain features for enhancing heat dissipation, such as, for example, channels extending from the exterior of the connector to an interior of the connector, and housing voids or gaps adjacent surface portions of the retained power contacts.

The number, positioning, and geometry of the cantilevered beams extending from the contacts is not limited to that shown in the figures. Some of the beam configurations discussed above have purported benefits; however, other beam configurations contemplated by the present invention may not have the same purported benefits.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. Matable power contacts, comprising:

a) a first power contact including a first pair of opposing non-deflecting beams and a first pair of opposing deflectable beams; and b) a second power contact including a second pair of opposing non-deflecting beams and a second pair of opposing deflectable beams;

wherein the first pair of opposing non-deflecting beams are in registration with the second pair of opposing deflectable beams and the first pair of opposing deflectable beams are in registration with the second pair of opposing non-deflecting beams.

2. The matable power contacts of claim 1, wherein the first power contact includes at least one pair of opposing plate-like body members and a medial space therebetween.

3. The matable power contacts of claim 1, wherein the first power contact includes at least one pair of plate-like body members that are stacked against one another.

4. The matable power contacts of claim 1, wherein the first power contact includes a first plate-like body member disposed proximate a second plate-like body member so that the first and second plate-like body members are touching one another along at least a portion of facing body member surfaces.

5. The matable power contacts of claim 1, further comprising an insulative housing, wherein the first power contacts are attached to the insulative housing.

6. A power contact, comprising:

a first plate that defines a first non-deflecting beam and a first deflectable beam; and a second plate that defines a second non-deflecting beam and a second deflectable beam, wherein the first plate and the second plate are positioned beside one another to form the power contact, and the first non-deflecting beam opposes the second non-deflecting beam in a direction normal to the plane of the contact.

7. The power contact of claim 6, wherein the first non-deflecting beam and the second non-deflecting beam each extend parallel to one another.

8. The power contact of claim 6, wherein the first non-deflecting beam and the second non-deflecting beam define a bifurcated single non-deflecting beam having at least two opposed contact surfaces.

9. The power contact of claim 8, wherein the first non-deflecting beam and the second non-deflecting beam physically touch one another.

10. The power contact of claim 6, wherein the first plate is stacked against the second plate so that the first and second plates are touching one another along at least a portion of opposing plate surfaces.

11. The power contact of claim 6, wherein the first plate is spaced apart from the second plate.

12. The power contact of claim 6, wherein the power contact includes a first region wherein the first plate is stacked against the second plate and a second region wherein the first plate is spaced apart from the second plate.

13. The power contact of claim 12, wherein the first and second regions are connected by an angled region.

14. An electrical connector, comprising:

an insulative housing; and a power contact in accordance with claim 6 disposed in the insulative housing.

15. The power contact of claim 6, wherein the first deflectable beam opposes the second deflectable beam.

16. The electrical connector of claim 14, wherein the insulative housing has an aperture formed therein that facilitates heat transfer from the power contact.

17. The electrical connector of claim 16, wherein the aperture is aligned with the first and second plates.

18. The electrical connector of claim 16, wherein the power contact mates with a second power contact and the housing has an opening formed therein for receiving the second power contact.

19. The electrical connector of claim 17, wherein the housing has a second aperture aligned with the first and second non-deflecting beams and the first and second deflectable beams.

20. The electrical connector of claim 16, wherein the aperture adjoins a channel formed between one of the first and second plates and an adjacent wall of the housing.

21. The power contact of claim 6, wherein;

the first plate has a lower section and an upper section having a notch formed therein for receiving the lower section; and the second plate has a lower section and an upper section having a notch formed therein for receiving the lower section of the second plate.

22. The power contact of claim 21, wherein the upper section of the first and second plates are substantially L-shaped.

23. The power contact of claim 22, wherein:

the upper section of the first plate defines the first non-deflecting beam and the first deflectable beam;

the upper section of the second plate defines the second non-deflecting beam and the second deflectable beam;

the lower section of the first plate defines a third non-deflecting beam and a third deflectable beam;

the lower section of the second plate defines a fourth non-deflecting beam and a fourth deflectable beam; and the third non-deflecting beam opposes the fourth non-deflecting beam.

24. An electrical connector, comprising:

an insulative housing; and a power contact in accordance with claim 23 disposed in the insulative housing so that the upper sections of the first and second plates are located in a first contact position, and the lower sections of the first and second plates are located in a second contact position adjacent the first contact position.

25. A power contact, comprising:

a first plate that defines a first non-deflecting beam and a first deflecting beam; and a second plate that defines a second non-deflecting beam and a second deflectable beam, wherein the first plate and the second plate are positioned beside and abut one another to form the power contact, and the first deflectable beam and the second deflectable beam extend parallel to one another and are completely spaced apart from one another.

* * * * *